US006558616B2

(12) United States Patent
Ito et al.

(10) Patent No.: US 6,558,616 B2
(45) Date of Patent: May 6, 2003

(54) ELECTRODE FOR PTC THERMISTOR AND METHOD FOR PRODUCING THE SAME, AND PTC THERMISTOR

(75) Inventors: Masahiro Ito, Oasaka (JP); Masakazu Tanahashi, Osaka (JP); Toshiro Kume, Osaka (JP); Kouichi Morimoto, Osaka (JP); Junji Kojima, Osaka (JP); Emiko Igaki, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/776,989

(22) Filed: Feb. 5, 2001

(65) Prior Publication Data

US 2002/0011919 A1 Jan. 31, 2002

Related U.S. Application Data

(62) Division of application No. 09/432,821, filed on Oct. 29, 1999.

(30) Foreign Application Priority Data

May 10, 1999 (JP) ..... 11-128219

(51) Int. Cl.[7] ..... B22F 7/04

(52) U.S. Cl. ..... 419/7; 427/125; 427/195; 427/205; 427/299; 427/328

(58) Field of Search ..... 419/7; 427/125, 427/192, 205, 299, 328

(56) References Cited

U.S. PATENT DOCUMENTS

| | | | | |
|---|---|---|---|---|
| 3,975,307 A | | 8/1976 | Matsuo et al. | |
| 4,053,864 A | | 10/1977 | Rodriguez et al. | |
| 4,056,365 A | | 11/1977 | Bevington et al. | |
| 4,482,801 A | | 11/1984 | Habata et al. | |
| 4,596,746 A | | 6/1986 | Morishita et al. | |
| 4,689,475 A | | 8/1987 | Kleiner et al. | |
| 4,800,253 A | | 1/1989 | Kleiner et al. | |
| 4,831,432 A | | 5/1989 | Hori et al. | |
| 5,354,969 A | * | 10/1994 | Akiyama et al. | 219/541 |
| 5,358,793 A | * | 10/1994 | Hanada et al. | 428/560 |
| 5,422,190 A | | 6/1995 | Alexander | |
| 5,482,782 A | | 1/1996 | Tanaka et al. | |
| 5,562,972 A | * | 10/1996 | Sasaki | 428/209 |
| 5,679,469 A | | 10/1997 | Shimoda et al. | |
| 5,725,938 A | | 3/1998 | Jin et al. | |
| 5,729,189 A | | 3/1998 | Oya et al. | |
| 5,763,105 A | | 6/1998 | Peuker | |
| 5,817,397 A | | 10/1998 | Kamiya et al. | |
| 5,874,885 A | | 2/1999 | Chandler et al. | |
| 5,955,936 A | | 9/1999 | Shar, Jr. et al. | |
| 6,015,775 A | | 1/2000 | Takayama et al. | |

FOREIGN PATENT DOCUMENTS

| | | |
|---|---|---|
| EP | 790 625 | 8/1997 |
| JP | 5-21208 | 1/1993 |
| JP | 9-219302 | 8/1997 |
| JP | 10-125504 | 5/1998 |

* cited by examiner

*Primary Examiner*—Ngoclan Mai
(74) *Attorney, Agent, or Firm*—Merchant & Gould P.C.

(57) ABSTRACT

An electrode for a PTC thermistor of the present invention includes a base layer having electrical conductivity and a sintered layer formed on the base layer. The sintered layer is formed by sintering a conductive powder and has electrical conductivity, and has roughness on a surface thereof. Thus, the present invention can provide an electrode for a PTC thermistor that has a large adhesion to the conductive polymer and can be produced easily.

8 Claims, 8 Drawing Sheets

ELECTRODE FOR PTC THERMISTOR AND METHOD FOR PRODUCING THE SAME, AND PTC THERMISTOR

This application is a divisional of application Ser. No. 09/432,821, filed Oct. 29, 1999 , which application(s) are incorporated herein by reference.

BACKGROUND OF THE INVENTION

1. Field of the Invention

The present invention relates to an electrode for a PTC thermistor and a production method thereof, and a PTC thermistor using the same.

2. Description of the Prior Art

In recent years, overcurrent protective devices such a resettable fuse have been used increasingly to protect lithium electric cell batteries, interfaces of digital electronic equipment.

A thermistor having a positive temperature coefficient (hereinafter, referred to as PTC thermistor) is known as one of the overcurrent protective devices. The PTC thermistor includes a conductive polymer in which conductive particles are filled in a crystalline polymer, and a pair of electrodes that are arranged on both surfaces of the conductive polymer. When an overcurrent occurs in the PTC thermistor, the temperature of the conductive polymer increases to a temperature in the vicinity of the melting point of the crystalline polymer due to self-heating, so that the crystalline polymer expands in volume. When the crystalline polymer expands in the vicinity of the melting point, the conductive paths of the conductive particles in the crystalline polymer are broken. As a result, the resistance between the electrodes becomes high, and the current flowing through the PTC thermistor attenuates. In this manner, the PTC thermistor attenuates the overcurrent.

In the PTC thermistor, when the adhesion between the electrodes and the conductive polymer is weak, the following problem occurs. When an overcurrent is applied repeatedly, the electrical resistance between the electrodes and the conductive polymer becomes large. As a result, the reliability is reduced, or the PTC thermistor no longer operates properly as a device. Therefore, a strong adhesion is demanded between metal foils as the electrodes and the conductive polymer.

To enhance the adhesion between the metal foils and the conductor polymer, a PTC thermistor using a metal foil having roughness formed by electrodeposition is reported (Japanese Patent Publication No. 2788968). This patent discloses a method for forming a microrough surface by exposing a metal foil to an electrolyte, followed by electrodeposition.

However, the conventional method for forming roughness on a surface of a metal foil by electrodeposition as described above has a problem in that the adhesion between the conductive polymer, which is a resin, and the metal foils is not necessarily sufficient. For this reason, the conventional PTC thermistor as described above has a problem in that repeated application of overcurrent increases the change ratio in resistance.

Furthermore, since an electrodeposition treatment requires a long period of time, the production cost is high. In addition, it is difficult to control a plating solution during an electrodeposition treatment, so that a metal foil with a stable quality cannot be obtained.

SUMMARY OF THE INVENTION

Therefore, with the foregoing in mind, it is an object of the present invention to provide an electrode for a PTC thermistor that has a large adhesion to the conductive polymer and can be produced easily, and a production method thereof, and a PTC thermistor using the same.

An electrode for a PTC thermistor of the present invention includes a base layer having electrical conductivity and a sintered layer formed on the base layer. The sintered layer is formed by sintering a conductive powder and has electrical conductivity, and has roughness on a surface thereof. The present invention can provide an electrode for a PTC thermistor that has a large adhesion to the conductive polymer and can be produced easily.

In the electrode for a PTC thermistor of the present invention, preferably, the center line average roughness Ra of the sintered layer is from 0.5 $\mu$m to 20 $\mu$m. This embodiment can provide an electrode for a PTC thermistor that has a particularly large adhesion to the conductive polymer.

In the electrode for a PTC thermistor of the present invention, preferably, the average particle diameter of the conductive powder is from 0.1 $\mu$m to 50 $\mu$m. This embodiment can provide an electrode for a PTC thermistor that has a particularly large adhesion to the conductive polymer.

In the electrode for a PTC thermistor of the present invention, preferably, a metal coating is formed on the surfaces of the particles of the conductive powder. This embodiment can provide an electrode for a PTC thermistor where the sintered layer can be formed easily.

In the electrode for a PTC thermistor of the present invention, the base layer is formed of a metallic material, and the metal coating may be formed of the same material as that of the base layer. In this embodiment, the diffusion speeds of the base layer and the conductive powder during sintering are equal. Therefore, the base layer and the conductive powder are bonded by sintering in a short time. Thus, this embodiment can provide an electrode for a PTC thermistor where the sintered layer can be formed particularly easily.

In the electrode for a PTC thermistor of the present invention, the base layer may be formed of a metallic material, and the metal coating may be formed of a material having a melting point lower than that of the base layer. Since the conductive powder can be sintered at low temperatures, this embodiment can provide an electrode for a PTC thermistor where the sintered layer can be formed particularly easily.

In the electrode for a PTC thermistor of the present invention, preferably, the conductive powder includes a powder containing conductive particles that are linked one after another. This embodiment can provide an electrode for a PTC thermistor having a particularly large adhesion to the conductive polymer, because the volume of voids in the sintered layer can be increased.

In the electrode for a PTC thermistor of the present invention, preferably, the conductive powder includes a first powder having electrical conductivity and a second powder having electrical conductivity. The average particle diameter of the first powder is at least twice the average particle diameter of the second powder. This embodiment can provide an electrode for a PTC thermistor where the sintered layer can be formed particularly easily, because the second powder having a small particle diameter is arranged in voids formed by the first powder having a large particle diameter.

In the electrode for a PTC thermistor of the present invention, preferably, the content of the second powder in the conductive powder is not more than 60 wt %. This embodiment can provide an electrode for a PTC thermistor that has a sufficient adhesion to the conductive polymer and where the sintered layer can be formed particularly easily, because the first powder having a large particle diameter ensures the adhesion to the conductive polymer.

Preferably, the electrode for a PTC thermistor of the present invention further includes a metal film between the base layer and the sintered layer. This embodiment can provide an electrode for a PTC thermistor where the base layer and the conductive powder can be bonded by sintering easily.

In the electrode for a PTC thermistor of the present invention, preferably, the metal film includes at least one element selected from the group consisting of nickel, copper, silver, gold, palladium, titanium, zinc, molybdenum, tungsten, manganese, lead, chromium, platinum, tin, cobalt and indium. This embodiment can provide an electrode for a PTC thermistor where the base layer and the conductive powder can be bonded by sintering particularly easily.

In the electrode for a PTC thermistor of the present invention, preferably, the base layer has roughness on a surface thereof. This embodiment can provide an electrode for a PTC thermistor having a large adhesion between the base layer and the sintered layer.

In the electrode for a PTC thermistor of the present invention, preferably, the sintered layer includes a first sintered layer and a second sintered layer laminated in this order from the side of the base layer. The first sintered layer is formed by sintering a conductive powder with an average particle diameter of 0.1 $\mu$m to 1 $\mu$m. The second sintered layer is formed by sintering a conductive powder with an average particle diameter of not less than 1 $\mu$m. In this embodiment, the first sintered layer increases adhesion between the base layer and the sintered layer, and the second sintered layer increases adhesion between the sintered layer and the conductive polymer. Thus, this embodiment can provide an electrode for a PTC thermistor having large adhesion both between the base layer and the sintered layer and between the sintered layer and the conductive polymer.

In the electrode for a PTC thermistor of the present invention, preferably, the conductive powder is formed of a metallic material comprising at least one element selected from the group consisting of iron, nickel, copper, silver, gold, palladium, zinc, molybdenum, tungsten, manganese, lead, chromium, platinum, tin, cobalt, indium and titanium. This embodiment can provide an electrode for a PTC thermistor having an excellent electrical conductivity, because the conductive powder has a good electrical conductivity so that the contact resistance with the conductive polymer can be small.

In the electrode for a PTC thermistor of the present invention, preferably, the base layer is formed of a metallic material comprising at least one element selected from the group consisting of iron, copper and nickel. This embodiment can provide an electrode for a PTC thermistor having a particularly excellent electrical conductivity.

A method for producing an electrode for a PTC thermistor of the present invention includes the first step of coating a surface of a base layer having electrical conductivity with a paste containing a conductive powder; and the second step of forming a sintered layer where the conductive powder is sintered by subjecting the paste to a heat treatment. The method for producing an electrode for a PTC thermistor of the present invention allows the electrode for a PTC thermistor of the present invention to be produced easily Furthermore, the method for producing an electrode for a PTC thermistor of the present invention allows the sintered layers having various center line average roughnesses Ra to be formed easily by changing the particle diameter or shape of the conductive powder contained in the paste, or the film thickness of the sintered layer.

In the method for producing an electrode for a PTC thermistor of the present invention, preferably, the average particle diameter of the conductive powder is from 0.1 $\mu$m to 50 $\mu$m. This embodiment makes it possible to produce an electrode for a PTC thermistor having a particularly large adhesion to the conductive polymer.

Preferably, the method for producing an electrode for a PTC thermistor of the present invention further includes the step of forming a metal film on a surface of the base layer before the first step. This embodiment makes it possible to bond the base layer and the conductive powder by sintering particularly easily.

Preferably, the method for producing an electrode for a PTC thermistor of the present invention further includes the step of forming roughness on a surface of the base layer before the first step. This embodiment makes it possible to produce an electrode for a PTC thermistor having a large adhesion between the base layer and the sintered layer.

In the method for producing an electrode for a PTC thermistor of the present invention, preferably, the average particle diameter of the conductive powder is from 0.1 $\mu$m to 1 $\mu$m. The method further includes a third step of coating the sintered layer with a paste containing a conductive powder with an average particle diameter of not less than 1 $\mu$m and performing a heat treatment so as to form another sintered layer laminated on the sintered layer. This embodiment makes it possible to laminate a dense sintered layer and a sintered layer having a large number of voids in this order from the side of the base layer, so that an electrode for a PTC thermistor including a sintered layer having large adhesion to the base layer and the conductive polymer can be produced.

In the method for producing an electrode for a PTC thermistor of the present invention, preferably, the first step further includes the step of pressing the paste with which the base layer is coated into a sheet and drying the paste after the coating step. This embodiment makes it possible to bond the base layer and the conductive powder by sintering easily.

In the method for producing an electrode for a PTC thermistor of the present invention, preferably, the heat treatment is performed in a reducing atmosphere. This embodiment makes it possible to form a sintered layer whose surface is not oxidized. Thus, an electrode for a PTC thermistor having a particularly small change ratio in resistance can be produced by using the electrode for a PTC thermistor including such a sintered layer.

In the method for producing an electrode for a PTC thermistor of the present invention, preferably, the conductive powder is formed of a metallic material comprising at least one element selected from the group consisting of iron, nickel, copper, silver, gold, palladium, zinc, chromium, platinum, tin, cobalt, indium and titanium.

In the method for producing an electrode for a PTC thermistor of the present invention, preferably, the base layer is formed of a metallic material comprising at least one element selected from the group consisting of iron, copper and nickel. This embodiment makes it possible to produce an electrode for a PTC thermistor having an excellent electrical conductivity.

A PTC thermistor of the present invention includes at least one pair of electrodes and a conductive polymer arranged between the pair of electrodes (a plurality of pairs of electrodes may be included). The electrodes include a base layer having electrical conductivity and a sintered layer formed on a surface of the base layer on the side of the conductive polymer. The sintered layer is formed by sintering a conductive powder and has electrical conductivity, and has roughness on a surface thereof. This embodiment can provide a PTC thermistor having a small change ratio in resistance when an overcurrent is applied repeatedly, because the adhesion between the electrodes and the conductive polymer is large.

In the PTC thermistor of the present invention, preferably, the center line average roughness Ra of the sintered layer is from 0.5 $\mu$m to 20 $\mu$m. This embodiment can provide a PTC thermistor having a particularly small change ratio in resistance when an overcurrent is applied repeatedly, because the adhesion between the electrodes and the conductive polymer is particularly large.

In the PTC thermistor of the present invention, preferably, the average particle diameter of the conductive powder is from 0.1 $\mu$m to 50 $\mu$m. This embodiment can provide a PTC thermistor having a still more particularly small change ratio in resistance when an overcurrent is applied repeatedly.

In the PTC thermistor of the present invention, preferably, the conductive powder is formed of a metallic material comprising at least one element selected from the group consisting of iron, nickel, copper, silver, gold, palladium, zinc, chromium, platinum, tin, cobalt, indium and titanium. This embodiment can provide a PTC thermistor having a small electrical resistance, because the conductive powder has a good electrical conductivity so that the contact resistance with the conductive polymer can be small.

In the PTC thermistor of the present invention, preferably, the base layer is formed of a metallic material comprising at least one element selected from the group consisting of iron, copper and nickel. This embodiment can provide a PTC thermistor having a small electrical resistance, because the base layer has a good electrical conductivity.

As described above, the electrode for a PTC thermistor of the present invention includes a base layer having electrical conductivity and a sintered layer formed on the base layer. The sintered layer is formed by sintering a conductive powder and has electrical conductivity. Therefore, the electrode for a PTC thermistor according to the present invention has large adhesion to the conductive polymer and can be produced easily.

Furthermore, the method for producing the electrode for a PTC thermistor of the present invention includes the first step of coating a surface of a base layer having electrical conductivity with a paste containing a conductive powder, and the second step of forming a sintered layer containing the conductive powder by heating the paste. Therefore, according to this method, the electrode for a PTC thermistor of the present invention can be produced easily. In particular, according to this method, the center line average roughness can be controlled easily by changing the particle shape or particle diameter of the conductive powder in the paste or the film thickness of the sintered layer.

The PTC thermistor of the present invention includes a pair of electrodes and a conductive polymer arranged between the pair of electrodes and is characterized by using the electrodes for a PTC thermistor of the present invention. Therefore, the PTC thermistor of the present invention has a large adhesion between the electrodes for a PTC thermistor and the conductive polymer and a small change in resistance even if an overcurrent is applied repeatedly.

These and other advantages of the present invention will become apparent to those skilled in the art upon reading and understanding the following detailed description with reference to the accompanying figures.

DESCRIPTION OF THE PREFERRED EMBODIMENTS

Hereinafter, preferred embodiments of the present invention will be described with reference to the accompanying drawings.

Embodiment 1

Figure 1:
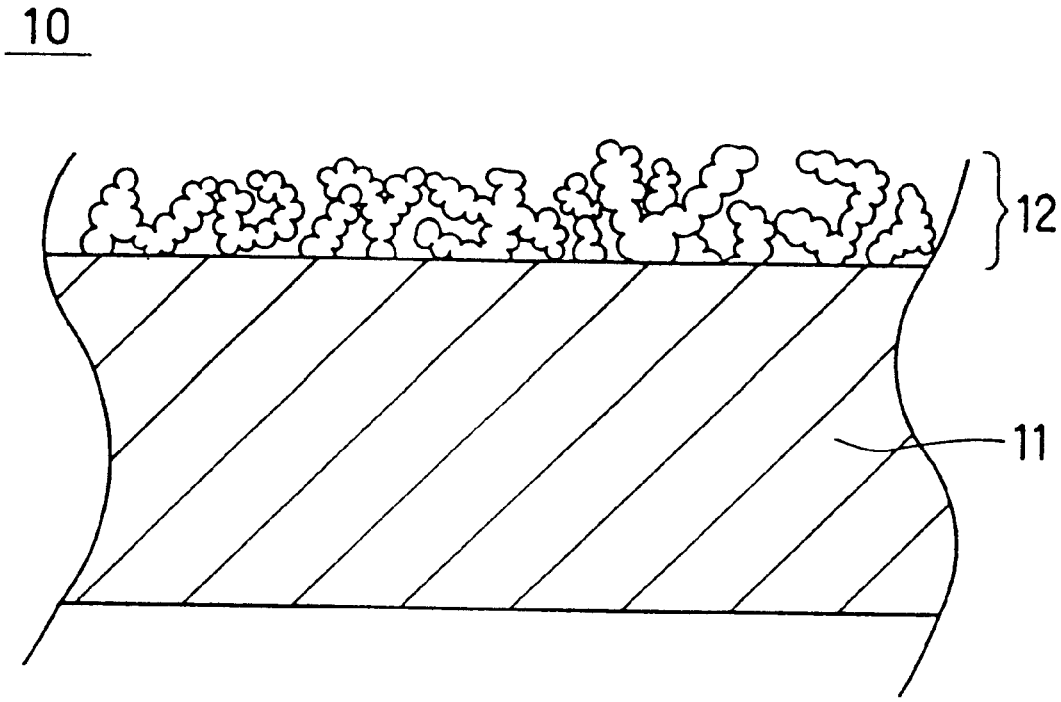
FIG. 1 is a cross-sectional view showing an example of an electrode for a PTC thermistor of the present invention.

In Embodiment 1, an example of an electrode for a PTC thermistor of the present invention will be described. FIG. 1 is a schematic view showing an electrode 10 for a PTC thermistor of Embodiment 1.

Referring to FIG. 1, the electrode 10 for a PTC thermistor includes a base layer 11 having electrical conductivity and a sintered layer 12 (hatching is omitted) formed on the base layer 11.

The base layer 11 is formed of a conductive material, such as a foil made of a metal (including an alloy or a compound containing a non-metal element and a metal element, which also applies to the following), a metal sheet, a punching metal, a conductive resin, a conductive ceramic material or the like. Among these, a metallic material is preferable for the base layer 11. More specifically, a metallic material containing at least one element selected from the group consisting of copper, nickel and iron can be used as the material of the base layer 11. For example, the base layer 11 can be formed of copper, nickel or iron, alloys of these elements, or compounds of these elements and a non-metal element. Among these, copper or a copper alloy is most preferable.

Figure 2:
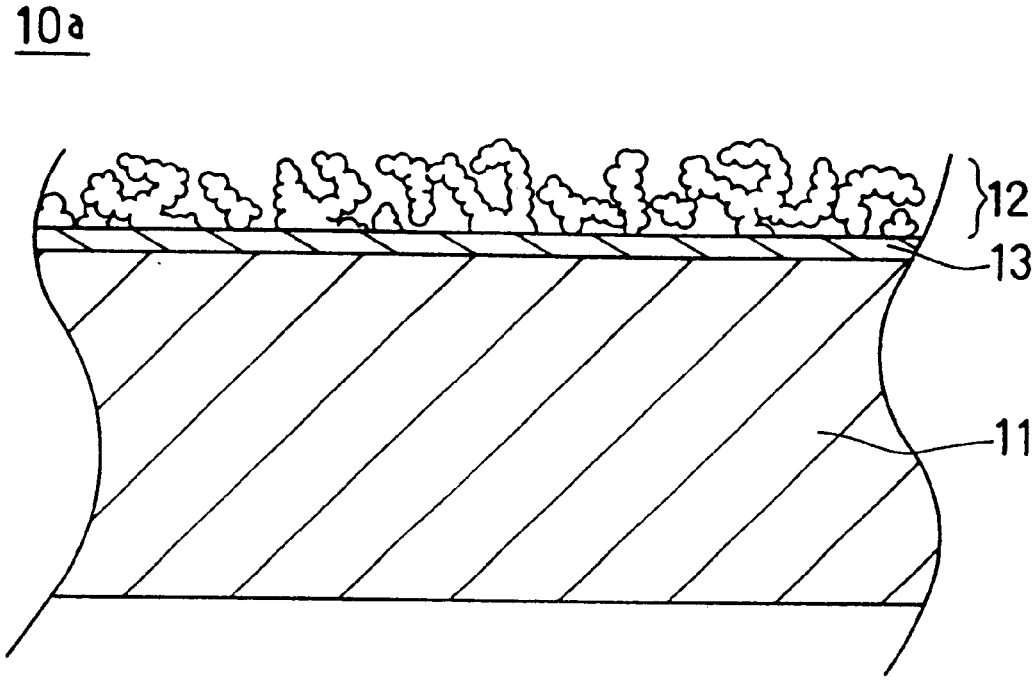
FIG. 2 is a cross-sectional view showing another example of an electrode for a PTC thermistor of the present invention.

A metal film 13 may be formed on a surface of the base layer 11 (between the base layer 11 and the sintered layer 12). FIG. 2 shows an electrode 10*a* for a PTC thermistor as an example of this case. The metal film 13 preferably contains at least one element selected from the group consisting of nickel, copper, silver, gold, palladium, titanium, zinc, chromium, platinum, tin, cobalt, and indium. For example, nickel, copper, nickel boron, or nickel phosphorus can be used for the metal film 13. The thickness of the metal film 13 is 0.1 $\mu$m to 10 $\mu$m, preferably 1 $\mu$m to 3 $\mu$m.

Figure 3:
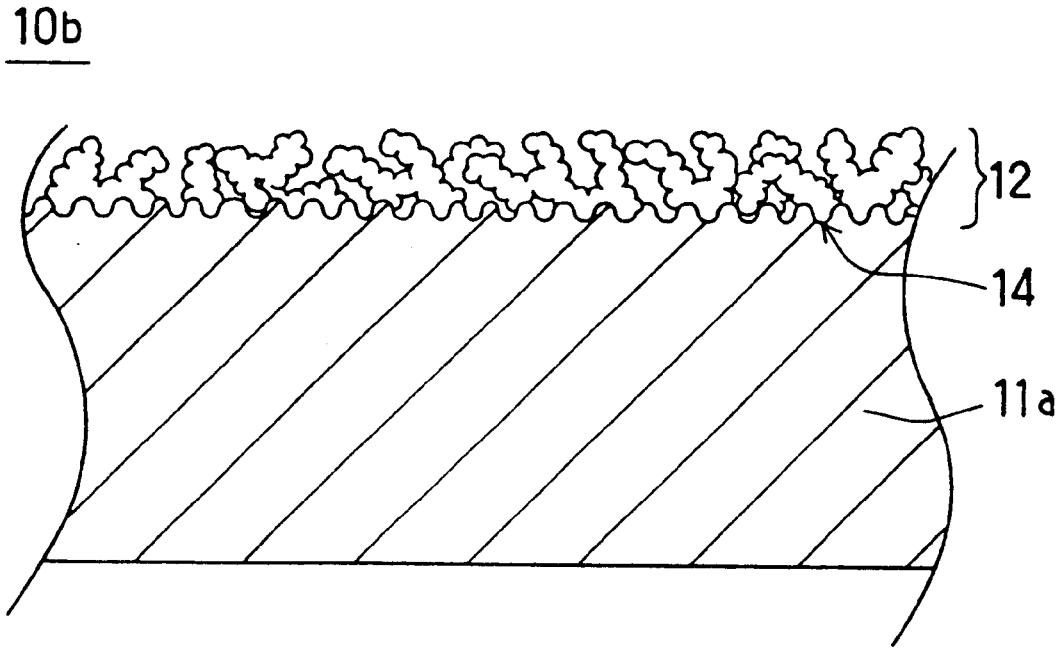
FIG. 3 is a cross-sectional view showing still another example of an electrode for a PTC thermistor of the present invention.

Furthermore, the base layer 11 may have roughness 14 on a surface (hereinafter, the base layer 11 in this case is referred to as a base layer 11*a*). FIG. 3 shows an electrode 10*b* for a PTC thermistor as an example of this case. Further, a metal film 13 may be formed on the roughness 14.

The sintered layer 12 is formed by sintering a conductive powder and has electrical conductivity, and has roughness on a surface. The sintered layer 12 is formed on at least one principal surface of the base layer 11. The center line average roughness Ra of the surface of the sintered layer 12 is preferably from 0.5 μm to 20 μm (the center line average roughness Ra will be described in the last part of Embodiment 1). Most preferably, the center line average roughness Ra of the sintered layer 12 is from 1 μm to 5 μm. This embodiment provides an electrode for a PTC thermistor having a particularly large adhesion to the conductive polymer.

Various particle diameters can be used for the conductive powder as a material of the sintered layer 12, but a conductive powder with an average particle diameter from 0.1 μm to 50 μm is preferable.

For the conductive powder, various materials having electrical conductivity can be used. For example, a metallic material, a conductive resin, a conductive ceramic material or the like can be used. For example, a metallic material containing at least one element selected from the group consisting of iron, nickel, copper, silver, gold, palladium, zinc, chromium, platinum, tin, cobalt, indium, and titanium can be used as the conductive powder. More specifically, for example, iron, nickel, copper, silver, gold, palladium, zinc, chromium, platinum, tin, cobalt, indium, or titanium, alloys of these elements, or compounds of these elements and a non-metal element can be used. Among these, nickel is most preferable.

The conductive powder may contain a first powder having electrical conductivity and a second powder having electrical conductivity. The average particle diameter of the first powder may be twice the average particle diameter of the second powder or larger than that. In this case, the content of the second powder contained in the conductive powder is preferably 60 wt % or less.

Furthermore, the particles of the conductive powder can be of various shapes such as spherical shape, needle-shape or ellipse, or can be linked one after another. As the conductive powder, a powder whose particle has a ratio of the major axis to the minor axis of 1.3 or more, a powder whose particle has a ratio of the long side to the short side of 1.3 or more, or a powder where conductive particles are linked one after another can be used preferably. This embodiment allows the sintered layer 12 to have voids in a large proportion so that an electrode for a PTC thermistor having a particularly large adhesion to the conductive polymer can be obtained.

A metal coating may be formed on the surfaces of the particles of the conductive powder. As the metal coating., for example, the same metallic material as that of the base layer 11, or a metallic material having a melting point lower than that of the base layer 11 can be used. The metal coating can be formed by plating, vapor deposition or the like.

Figure 4:
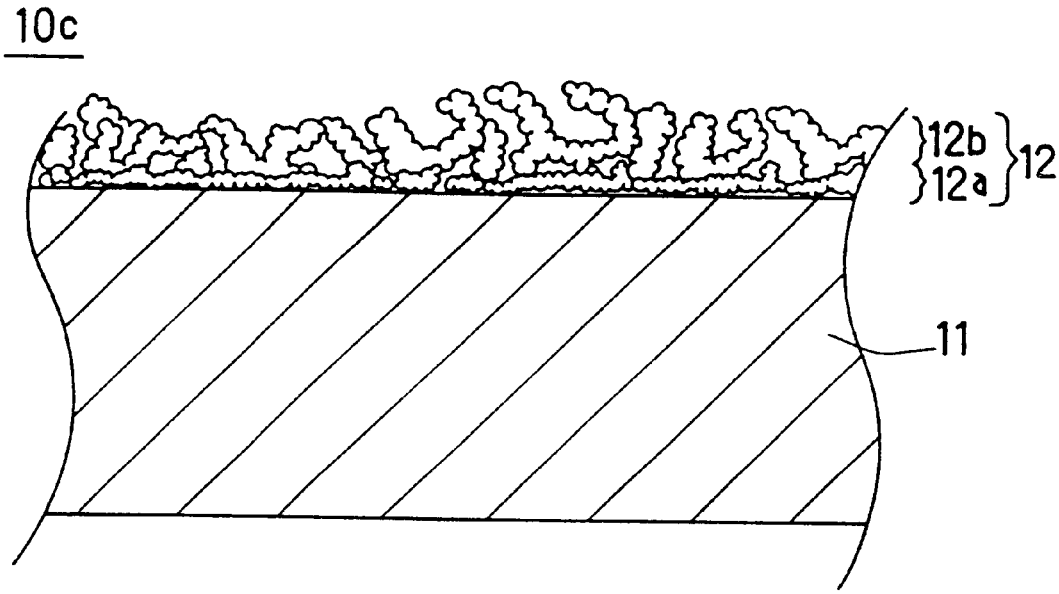
FIG. 4 is a cross-sectional view showing still yet another example of an electrode for a PTC thermistor of the present invention.

Furthermore, the sintered layer 12 may include two sintered layers. FIG. 4 shows an electrode 10*c* for a PTC thermistor as an example of this case. Referring to FIG. 4, the sintered layer 12 of the electrode 10*c* for a PTC thermistor includes a first sintered layer 12*a* and a second sintered layer 12*b* in this order from the side of the base layer 11. The first sintered layer 12*a* (dense sintered layer) has electrical conductivity and is formed by sintering a conductive powder with an average particle diameter of 0.1 μm to 1 μm. The second sintered layer 12*b* has electrical conductivity and is formed by sintering a conductive powder with an average particle diameter of more than 1 μm. Most preferably, the second sintered layer 12*b* is formed by sintering a conductive powder with an average particle diameter of 2.2 μm to 3.3 μm. This embodiment provides an electrode for a PTC thermistor having a particularly large adhesion to the conductive polymer when a PTC thermistor is formed therewith.

In the electrode 10 for a PTC thermistor of Embodiment 1, roughness is formed on the surface by forming the sintered layer 12 on the base layer 11. Therefore, the electrode 10 for a PTC thermistor can provide a large adhesion to the conductive polymer when a PTC thermistor is formed therewith. Furthermore, the electrode 10 for a PTC thermistor can be produced easily.

Figure 5:
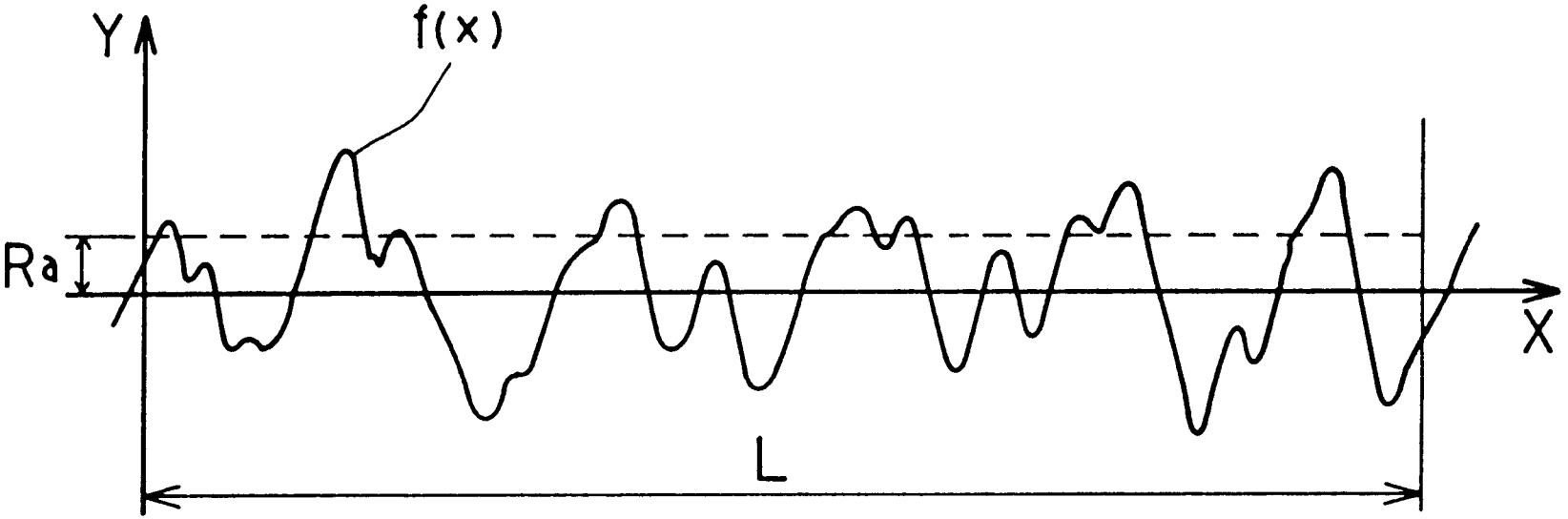
FIG. 5 is a schematic diagram showing a method for measuring the center line average roughness Ra.

Hereinafter, a method for measuring the center line average roughness Ra (B-0601 in JIS (Japanese Industrial Standard)) will be described. The center line average roughness Ra is a parameter that indicates a surface roughness. More specifically, in a roughness curve having a reference length L, when the x-axis is along the direction of the average line, the y-axis is along the direction perpendicular to the average line, and the roughness curve is represented by y=f(x), the center line average roughness Ra is the value obtained by the following equation in μm (refer to a schematic diagram of FIG. 5).

$$Ra = \frac{1}{L}\int_0^L |f(x)|dx$$

The center line average roughness Ra can be measured easily with a commercially available measurement apparatus (e.g., Surfcom 550A manufactured by TOKYO SEIMITSU CO.,LTD.).

Embodiment 2

In Embodiment 2, an example of a method for producing the electrode for a PTC thermistor of the present invention will be described. The same description as in Embodiment 1 will be omitted in Embodiment 2.

Figure 6:
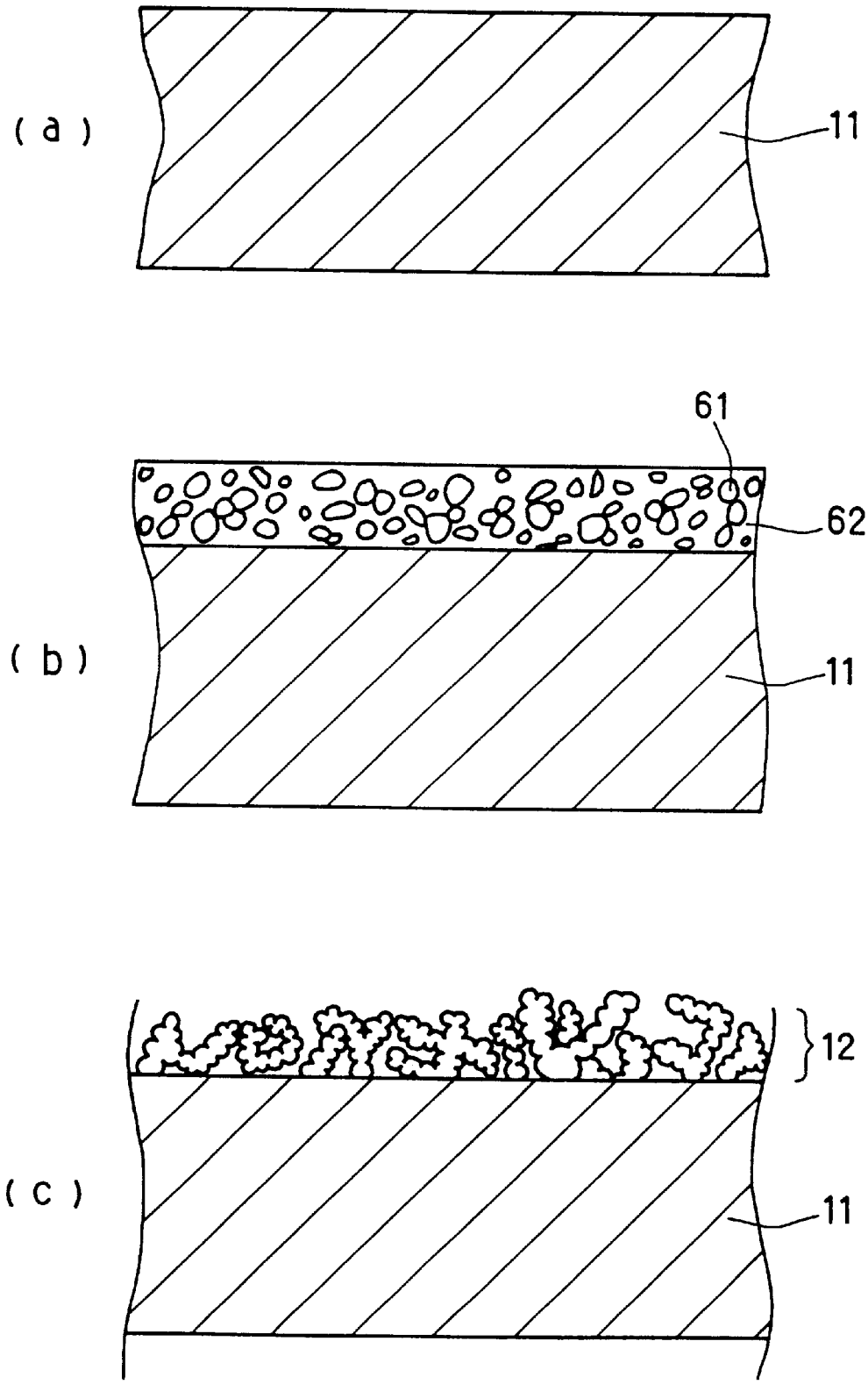
FIGS. 6(*a*), 6(*b*) and 6(*c*) are views showing a process sequence of an example of a method for producing a PTC thermistor of the present invention.

First, as shown in FIG. 6(*a*). the base layer 11 is prepared. In the case where the electrode 10*a* is to be produced, the base layer 11 including the metal film 13 on the surface thereof is used. The metal film 13 can be formed by plating or vapor deposition. In order to produce the electrode 10*b* for a PTC thermistor, the base layer 11*a* having roughness on the surface thereof is used. The base layer 11*a* can be formed by a treatment such as a chemical etching treatment, an electrolytic etching treatment, a sandblast treatment, a pressing treatment or metallicon (sprayed metal coating) or the like.

Thereafter, as shown in FIG. 6(*b*), a paste 62 (hatching is omitted) containing conductive powder 61 is applied onto a surface of the base layer 11.

The paste 62 is obtained by adding the conductive powder (the material of the sintered layer 12) described in Embodiment 1 to a solvent in which a polymer compound (binder) is dissolved and kneading the mixture. As the solvent that is a material of the paste 62, an organic solvent such as butyl acetate, butyl cellosolve, butyl carbitol, α terpineol or alcohol, or water can be used. As the polymer compound (binder) that is a material of the paste 62, a cellulose based resin such as methyl cellulose, ethyl cellulose, and cellulose nitrate, a polyvinyl alcohol based resin, a butyral based resin, an acrylic resin such as methyl methacrylate, a polyacetal resin, rosin or the like can be used.

More specifically, first, about 1 wt % to 10 wt % of a polymer compound is added to a solvent, and is heated so as to dissolve the polymer compound to prepare a vehicle. Thereafter, 100 parts by weight of the conductive powder are mixed with 50 to 150 parts by weight of the vehicle, and the mixture is kneaded sufficiently in a kneader to prepare the paste 62. The thus obtained paste 62 is applied to the base layer 11. The application can be performed by doctor blade, dip coating, die coating, reverse roll coating, screen printing, bar coating or the like. The vehicle may contain a plasticizer, an antifoamer, a dispersant or the like, if necessary.

Thereafter, the base layer 11 coated with the paste 62 is heated in a neutral atmosphere or an oxidative atmosphere so as to dry the paste 62 and remove the binder. Examples of the neutral atmosphere gas include nitrogen gas and carbon dioxide. Examples of the oxidative atmosphere gas include air. Nitrogen gas with water vapor added is most preferable.

After the paste 62 is applied and before the binder is removed, the paste 62 may be pressed into a sheet. The pressing can be performed, for example, by using a pressing apparatus such as a roll. In this case, when the pressing is performed, for example, at 40° C. or more, the bond between the conductive powder and the base layer 11 can improve.

Thereafter, the paste 62 is fired to form the sinter layer 12, as shown in FIG. 6(*c*). The firing is performed by heating in a reducing atmosphere at a temperature of 200° C. to 1200° C. for about 0.5 min. to 30 min. Examples of the reducing atmosphere gas include hydrogen-nitrogen mixed gas, hydrogen-carbon dioxide mixed gas, or these gases with water vapor added. After firing, the base layer 11 is cooled in a reducing atmosphere, if necessary. Thus, the electrode 10 can be produced.

In the case where the electrode 10*c* shown in FIG. 4 is to be produced, first, the paste 62 containing the conductive powder with an average particle diameter of 0.1 $\mu$m to 1 $\mu$m is used to form the sintered layer 12*a*. Then, the paste containing the conductive powder with an average particle diameter of 1 $\mu$m or more is applied onto the sintered layer 12*a* so as to form the sintered layer 12*b* by the same method as described with reference to the process of FIG. 6(*c*).

Figure 7:
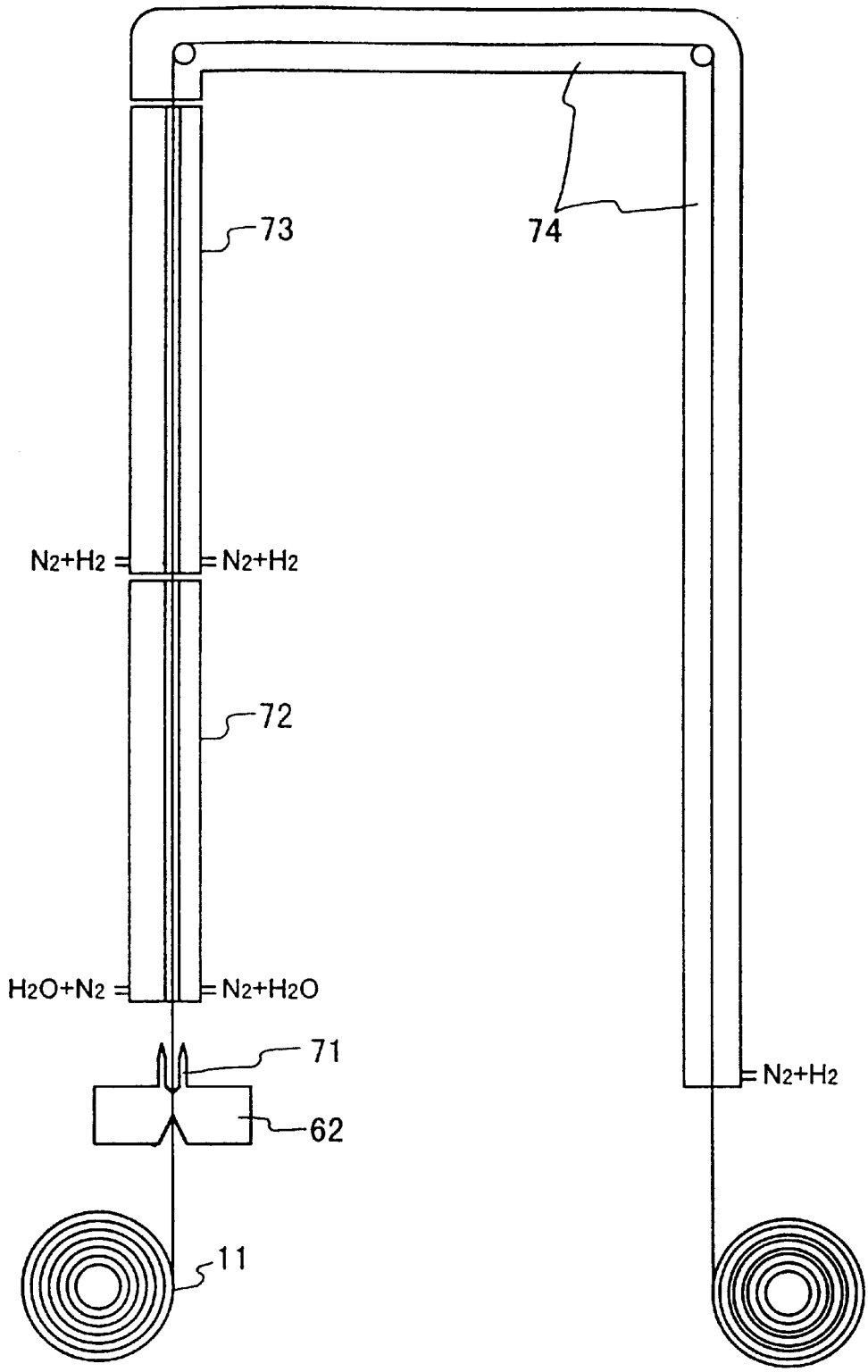
FIG. 7 is a schematic view showing an example of an apparatus used in the method for producing a PTC thermistor of the present invention.

FIG. 7 schematically shows an example of a sintering apparatus used in the above-described production method.

Referring to FIG. 7, the sintering apparatus includes a coater portion 71, a binder removal portion 72, a firing portion 73, and a cooling portion 74.

In the coater portion 71, the base layer 11 is coated with the paste 62.

In the binder removal portion 72, a heat treatment is performed at about 400° C. so as to dry the paste 62 with which the base layer 11 is coated and to remove the binder. It is preferable that the binder removal portion 72 is filled with a neutral atmosphere gas (e.g., nitrogen gas or carbon dioxide) or an oxidative atmosphere (e.g., air). Most preferably, the binder removal portion 72 is filled with a nitrogen gas with water vapor added. In order to sheet the paste 62, a pressing apparatus such as a roll is arranged between the coater portion 71 and the binder removal portion 72.

In the firing portion 73, a heat treatment is performed at about 200° C. to 1200° C. so as to form the sintered layer 12. It is preferable that the firing portion 73 is filled with a reducing atmosphere gas (e.g., hydrogen-nitrogen mixed gas, hydrogen-carbon dioxide mixed gas, or these gases with water vapor added).

In the cooling portion 74, the base layer 11 provided with the sintered layer 12 is cooled, for example, at about 100° C. to 500° C. It is preferable that the cooling portion 74 is filled with a reducing atmosphere gas or a neutral atmosphere gas.

Thereafter, the base layer 11 on which the sintered layer 12 is formed by the sintering apparatus is cut in a predetermined size to form the electrode 10.

The production method of Embodiment 2 can facilitate the production of the electrodes 10, 10*a*, 10*b* and 10*c* as described in Embodiment 1. In particular, the center line average roughness of the sintered layer 12 can be controlled easily by changing the particle diameter or shape of the conductive powder 61 contained in the paste 62.

Embodiment 3

In Embodiment 3, an example of a PTC thermistor of the present invention will be described.

Figure 8:
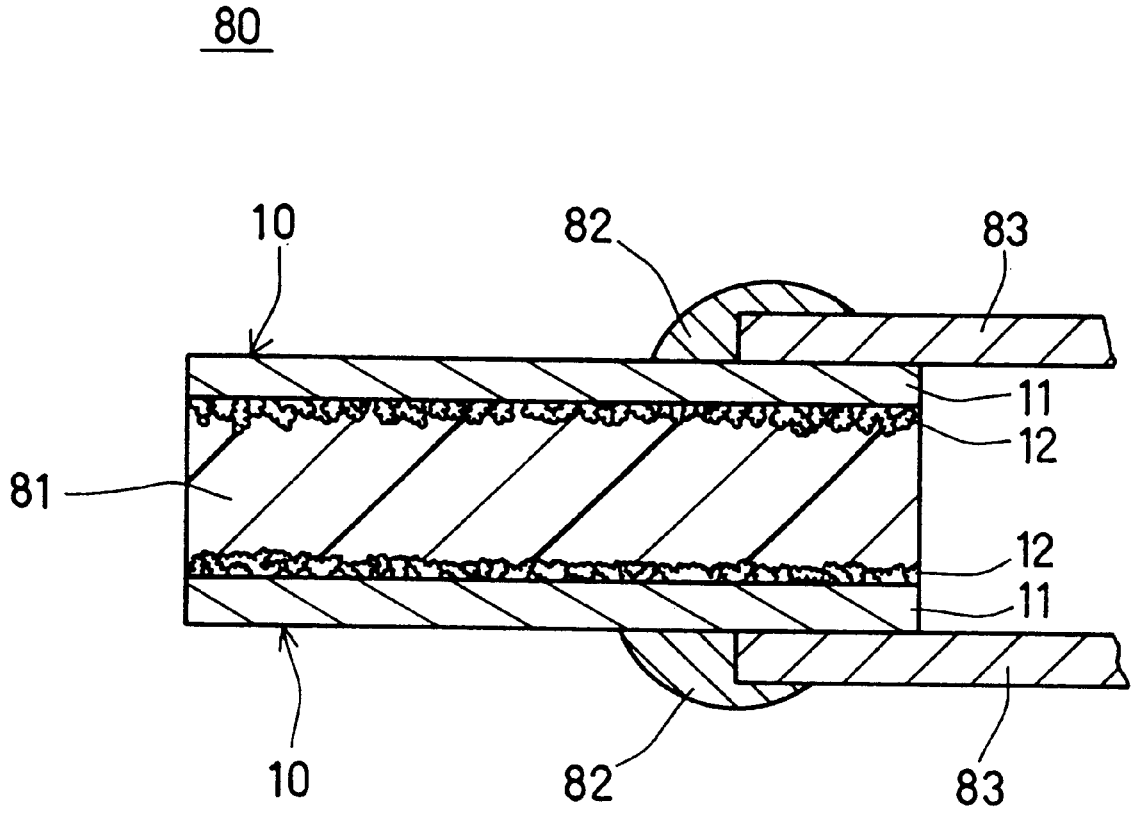
FIG. 8 is a cross-sectional view showing an example of a PTC thermistor of the present invention.

Referring to FIG. 8, a PTC thermistor 80 of Embodiment 3 includes at least a pair of electrodes 10 (including the electrodes 10*a*, 10*b*, and 10*c*), a conductive polymer 81 arranged between the pair of electrodes 10, and lead wires 83 connected to the electrodes 10 with solder 82.

The electrodes 10 for a PTC thermistor are the electrodes described in Embodiment 1 or the electrodes produced by the method of Embodiment 2. In the electrodes 10, the sintered layers 12 are arranged so as to be in contact with the conductive polymer 81.

The conductive polymer 81 has the PTC characteristics. As the conductive polymer 81, for example, a crystalline polymer containing conductive particles can be used. As the conductive particles in the conductive polymer 81, for example, carbon black can be used. As the crystalline polymer that is a material of the conductive polymer 81, for example, HDPE (high density polyethylene), LDPE (low density polyethylene), PP (polypropylene), or EVA (ethylene vinyl acetate copolymer) can be used.

Since the PTC thermistor 80 of Embodiment 3 includes the electrodes 10 of the present invention, the adhesion between the electrodes 10 and the conductive polymer 81 is strong. Therefore, according to the PTC thermistor 80, the change in resistance can be small even if an overcurrent is applied repeatedly.

The PTC thermistor of the present invention can be of any structure, as long as the electrodes 10 are provided, and is not limited to the structure shown in FIG. 8. For example, the PTC thermistor shown in FIG. 8 is provided with a pair of electrodes 10, but the, PTC thermistor of the present invention can be provided with two or more pairs of electrodes for a PTC thermistor. Furthermore, the PTC thermistor of the present invention can be a surface mount type or axial type PTC thermistor, or a multilayered PTC thermistor provided with at least three electrodes for a PTC thermistor.

EXAMPLES

Hereinafter, the electrode for a PTC thermistor and the PTC thermistor using the same will be described by way of examples.

Example 1

A vehicle was prepared by mixing 5 wt % of a butyral resin, 2 wt % of dibutyl phthalate as a plasticizer, and 45 wt % of butyl acetate and 48 wt % of butyl cellosolve as solvents (hereinafter, a vehicle having this mixing ratio is referred to as vehicle A). Then, 100 parts by weight of vehicle A and 100 parts by weight of a nickel powder (a conductive powder) with an average particle diameter of 4 μm were kneaded to prepare a paste. A copper foil 60 μm thick (base layer) was coated with this paste by a doctor blade method (the rate of the coating was 10 mm/sec, which also applies to the following examples) so that the thickness of the coating became 30 μm. Thereafter, a heat treatment was performed at 450° C. in a nitrogen gas or in the air so as to remove the binder. Then, another heat treatment was performed at 900° C. in a mixed gas of 55% of hydrogen and 45% of nitrogen (the percentage of the mixed gas is the ratio by volume, which also applies to the following examples) for 5 minutes to form a sintered layer. Thus, an electrode for a PTC thermistor was obtained. The center line average roughness Ra of a surface of the thus formed sintered layer was measured with Surfcom 550A (manufactured by TOKYO SEIMITSU CO.,LTD.) (a cutoff value of 0.8 mm and a reference length of 2.5 mm). The result was 5.5 μm. In the following examples, the center line average roughness Ra of a surface of the sintered layer was measured in the same manner.

Thereafter, a PTC thermistor was produced with the electrode produced as above. More specifically, first, 48 wt % of HDPE (made by Mitsui Chemicals, Inc.), which is a crystalline polymer and 52 wt % of carbon black (made by Mitsubishi Chemical Corp.) were mixed using two heat rolls that had been heated to 190° C. Then, the mixture was molded into a sheet 0.5 mm thick to prepare a conductive polymer sheet. The conductive polymer sheet was sandwiched by two electrodes for a PTC thermistor that were produced above, and the conductive polymer and the electrodes were attached under heat and pressure (150° C. and 50 kgf/cm$^2$ (490N/cm$^2$)) to give a laminate. Then, lead wires were attached to the copper foils on both sides of the laminate with solder to give a PTC thermistor.

With respect to the thus obtained PTC thermistor, an overcurrent application cycle test was performed. The overcurrent application cycle test consisted of 1000 cycles. Each cycle consisted of applying the current for 1 minute, and stopping the current for 5 minutes. In this case, the PTC thermistor was connected to a 12V direct current source and a load resistor so that an overcurrent of 40A was applied.

The resistance of the PTC thermistor was measured before and after the overcurrent application cycle test, and the change ratio in resistance before and after the overcurrent application cycle test was calculated. The change ratio in resistance is a value obtained by (the resistance after the test−the resistance before the test)/(the resistance before the test)×100(%). Table 1 shows an average value of the values obtained by measuring ten PTC thermistors of Example 1 (the values shown in Table 1 with respect to the following examples and the comparative example also are average values of ten PTC thermistors).

TABLE 1

| Samples | Resistance value (m Ω) before test | Resistance value (m Ω) after test | change ratio in resistance (%) | Samples | Resistance value (m Ω) before test | Resistance value (m Ω) after test | change ratio in resistance (%) |
|---|---|---|---|---|---|---|---|
| Ex. 1 | 40 | 50 | 25 | Ex. 26 | 45 | 59 | 31 |
| Ex. 2 | 38 | 46 | 21 | Ex. 27 | 45 | 59 | 31 |

TABLE 1-continued

| Samples | Resistance value (m Ω) before test | Resistance value (m Ω) after test | change ratio in resistance (%) | Samples | Resistance value (m Ω) before test | Resistance value (m Ω) after test | change ratio in resistance (%) |
|---|---|---|---|---|---|---|---|
| Ex. 3 | 42 | 55 | 31 | Ex. 28 | 40 | 58 | 45 |
| Ex. 4 | 45 | 60 | 33 | Ex. 29 | 45 | 63 | 40 |
| Ex. 5 | 48 | 65 | 35 | Ex. 30 | 43 | 52 | 21 |
| Ex. 6 | 36 | 42 | 17 | Ex. 31 | 44 | 57 | 30 |
| Ex. 7 | 42 | 54 | 29 | Ex. 32 | 46 | 54 | 17 |
| Ex. 8 | 48 | 62 | 29 | Ex. 33 | 44 | 56 | 27 |
| Ex. 9 | 41 | 52 | 27 | Ex. 34 | 38 | 47 | 24 |
| Ex. 10 | 42 | 54 | 29 | Ex. 35 | 47 | 61 | 30 |
| Ex. 11 | 45 | 57 | 27 | Ex. 36 | 45 | 62 | 38 |
| Ex. 12 | 48 | 59 | 23 | Ex. 37 | 45 | 58 | 29 |
| Ex. 13 | 43 | 61 | 42 | Ex. 38 | 43 | 52 | 21 |
| Ex. 14 | 46 | 63 | 37 | Ex. 39 | 44 | 63 | 43 |
| Ex. 15 | 42 | 58 | 38 | Ex. 40 | 39 | 49 | 26 |
| Ex. 16 | 45 | 62 | 38 | Ex. 41 | 41 | 50 | 22 |
| Ex. 17 | 41 | 56 | 37 | Ex. 42 | 40 | 50 | 25 |
| Ex. 18 | 42 | 56 | 33 | Ex. 43 | 39 | 51 | 31 |
| Ex. 19 | 39 | 57 | 46 | Ex. 44 | 42 | 57 | 36 |
| Ex. 20 | 48 | 70 | 46 | Ex. 45 | 45 | 61 | 36 |
| Ex. 21 | 49 | 66 | 35 | Ex. 46 | 43 | 64 | 47 |
| Ex. 22 | 43 | 60 | 40 | Ex. 47 | 40 | 49 | 23 |
| Ex. 23 | 45 | 59 | 31 | Ex. 48 | 41 | 48 | 17 |
| Ex. 24 | 41 | 56 | 37 | Com. Ex. | 50 | 98 | 96 |
| Ex. 25 | 42 | 55 | 31 | | | | |

Furthermore, with respect to the PTC thermistor of Example 1, the peel strength between the conductive polymer and the electrode for a PTC thermistor was measured (peeling test). Table 2 shows an average value of the values obtained by measuring five PTC thermistors of Example 1 (the values shown in Table 2 with respect to the following examples and the comparative example also are average values of five PTC thermistors). Here, 1 kgf/cm$^2$ is about 9.8N/cm$^2$.

TABLE 2

| Samples | Peel strength [kgf/cm$^2$] |
|---|---|
| Ex. 1 | 2.3 |
| Ex. 2 | 2.2 |
| Ex. 3 | 2.7 |
| Ex. 4 | 2.5 |
| Ex. 5 | 2.2 |
| Ex. 6 | 2.1 |
| Ex. 7 | 2.6 |
| Ex. 8 | 2.2 |
| Ex. 9 | 2.6 |
| Ex. 10 | 2.4 |
| Ex. 11 | 2.5 |
| Ex. 12 | 2.6 |
| Ex. 13 | 2.2 |
| Ex. 14 | 2.1 |
| Ex. 15 | 2.0 |
| Ex. 16 | 2.3 |
| Ex. 17 | 2.6 |
| Ex. 18 | 2.7 |
| Ex. 19 | 1.8 |
| Ex. 20 | 2.1 |
| Ex. 21 | 1.8 |
| Ex. 22 | 2.0 |
| Ex. 23 | 1.9 |
| Ex. 24 | 2.1 |
| Ex. 25 | 2.2 |
| Ex. 26 | 2.5 |
| Ex. 27 | 2.1 |
| Ex. 28 | 1.9 |

TABLE 2-continued

| Samples | Peel strength [kgf/cm$^2$] |
|---|---|
| Ex. 29 | 2.2 |
| Ex. 30 | 1.7 |
| Ex. 31 | 2.3 |
| Ex. 32 | 2.5 |
| Ex. 33 | 2.5 |
| Ex. 34 | 2.6 |
| Ex. 35 | 1.9 |
| Ex. 36 | 2.3 |
| Ex. 37 | 2.2 |
| Ex. 38 | 2.6 |
| Ex. 39 | 2.0 |
| Ex. 40 | 2.8 |
| Ex. 41 | 2.5 |
| Ex. 42 | 2.8 |
| Ex. 43 | 2.7 |
| Ex. 44 | 2.2 |
| Ex. 45 | 2.5 |
| Ex. 46 | 1.0 |
| Ex. 47 | 2.1 |
| Ex. 48 | 2.7 |
| Com. Ex. | 0.6 |

Example 2

In this Example, 100 g of an aqueous solution containing 3.5 wt % of methyl cellulose and 90 g of a silver powder (conductive powder) with an average particle diameter of 2 μm were kneaded sufficiently to prepare a paste. A copper foil 60 μm thick (base layer) was coated with this paste by the doctor blade method so that the thickness of the coating became 27 μm. Thereafter, a heat treatment was performed at 450° C. in a nitrogen gas or in the air so as to remove the binder. Then, another heat treatment was performed at 870° C. in a mixed gas (35% of hydrogen and 65% of nitrogen) for 5 minutes to form a sintered layer. Thus, an electrode for a PTC thermistor was obtained. The center line average roughness Ra of a surface of the thus formed sintered layer was 2 μm.

Thereafter, a PTC thermistor was produced with two electrodes produced as above, in the same manner as in Example 1. More specifically, the conductive polymer sheet produced under the same conditions as in Example 1 was sandwiched by the two electrodes for a PTC thermistor, and attached while heating at 150° C. and pressing at 50 kgf/cm$^2$ to give a laminate. Then, lead wires were attached to the copper foils on both sides of the laminate with solder to give a PTC thermistor (the PTC thermistors in the following examples were produced in the same manner). The overcurrent application cycle test and the peeling test were conducted under the same conditions as in Example 1 (see Tables 1 and 2)

Example 3

In this example, 100 g of vehicle A and 100 g of a nickel powder (conductive powder) with an average particle diameter of 3 μm were kneaded sufficiently to prepare a paste. A nickel foil 60 μm thick (base layer) was coated with this paste by the doctor blade method so that the thickness of the coating became 100 μm. Thereafter, a heat treatment was performed at 450° C. in a nitrogen gas or in the air so as to remove the binder. Then, another heat treatment was performed at 900° C. in a mixed gas (5% of hydrogen and 95% of nitrogen) for 5 minutes to form a sintered layer. Thus, an electrode for a PTC thermistor was obtained. The center line average roughness Ra of a surface of the thus formed sintered layer was 3.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 4

In this Example, 100 g of vehicle A and 100 g of a chromium powder (conductive powder) with an average particle diameter of 3 μm were kneaded sufficiently to prepare a paste. A nickel foil 60 μm thick (base layer) was coated with this paste by the doctor blade method so that the thickness of the coating became 27 μm. Thereafter, a heat treatment was performed at 450° C. in a nitrogen gas or in the air so as to remove the binder. Then, another heat treatment was performed at 1000° C. in a mixed gas (65% of hydrogen and 35% of nitrogen) for 5 minutes to form a sintered layer. Thus, an electrode for a PTC thermistor was obtained. The center line average roughness Ra of a surface of the thus formed sintered layer was 3.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

When a copper foil was used as the base layer, the same results as those of Example 4 shown in Tables 1 and 2 were obtained. When a gold powder, a platinum powder, a palladium powder, a brass powder, a bronze powder, a cobalt powder, a nickel silver powder, a copper powder, a copper powder plated with nickel, a tin powder or a zinc powder were used as the conductive powder, the same results as those of Example 4 were obtained.

Example 5

In this Example, 100 g of vehicle A and 100 g of a conductive powder (a mixture of 3 g of a zinc powder with an average particle diameter of 0.3 μm and 97 g of a copper powder with an average particle diameter of 2 μm) were kneaded sufficiently to prepare a paste. A nickel foil 60 μm thick (base layer) was coated with this paste by the doctor blade method so that the thickness of the coating became 27 μm. Thereafter, a heat treatment was performed at 390° C. in a mixed gas (10% of water vapor and 90% of nitrogen gas) so as to remove the binder. Then, another heat treatment was performed at 800° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 2.5 μm. When a copper foil 60 μm thick was used as the base layer, the same center line average roughness Ra was obtained.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 6

In this Example, 80 g of vehicle A and 100 g of a gold powder (conductive powder) with an average particle diameter of 3 μm were kneaded sufficiently to prepare a paste. A nickel foil 60 μm thick (base layer) was coated with this paste by the doctor blade method so that the thickness of the coating became 27 μm. Thereafter, a heat treatment was performed at 390° C. in a nitrogen gas or in the air so as to remove the binder. Then, another heat treatment was performed at 980° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 2 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 7

In this Example, 100 g of vehicle A and 100 g of a cobalt powder (conductive powder) with an average particle diameter of 3 μm were kneaded sufficiently to prepare a paste. A copper foil 60 μm thick (base layer) was coated with this paste by the doctor blade method so that the thickness of the coating became 27 μm. Thereafter, a heat treatment was performed at 450° C. in a nitrogen gas or in the air so as to remove the binder. Then, another heat treatment was performed at 900° C. in a mixed gas (25% of hydrogen and 75% of nitrogen) for 5 minutes to form a sintered layer. Thus, an electrode for a PTC thermistor was obtained. The center line average roughness Ra of a surface of the thus formed sintered layer was 4 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

In Example 7, the same results were obtained also when a copper foil or a nickel foil was used as the base layer. Furthermore, in Example 7. the sintering was possible in a gas having a hydrogen gas content of 0.1% to 100% (the same is true in the other examples). The sintering was completed in a shorter period of time when the binder was removed in a nitrogen gas than in the air. The sintering time was even shorter when the binder was removed in a nitrogen gas with water vapor added.

Example 8

In this Example, 100 g of vehicle A and 100 g of a nickel powder (conductive powder) with an average particle diameter of 3 μm were kneaded sufficiently to prepare a paste. A stainless steel foil 60 μm thick (base layer made of SUS304) was coated with this paste by the doctor blade method so that the thickness of the coating became 27 μm. Thereafter, a heat treatment was performed at 450° C. in a nitrogen gas or in the air so as to remove the binder. Then, another heat treatment was performed at 900° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 3.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 9

In this Example, 120 g of vehicle A and 100 g of a conductive powder (a mixture of 80 g of a nickel powder with an average particle diameter of 3 μm and 20 g of a nickel powder with an average particle diameter of 1 μm or less) were kneaded sufficiently to prepare a paste. A base layer (a copper foil 60 μm thick) plated with nickel 10 μm thick was coated with this paste by the doctor blade method so that the thickness of the coating became 27 μm. Thereafter, a heat treatment was performed at 450° C. in a nitrogen gas or in the air so as to remove the binder. Then, another heat treatment was performed at 890° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 4 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

When a copper foil plated with chromium was used as the base layer, the same results were obtained.

Example 10

In this Example, 120 g of vehicle A and 100 g of a conductive powder (a mixture of 80 g of a nickel powder with an average particle diameter of 3 μm and 20 g of a nickel powder with an average particle diameter of 1 μm or less) were kneaded sufficiently to prepare a paste. A base layer (a copper foil 60 μm thick) plated with nickel 1.5 μm thick was coated with this paste by the doctor blade method so that the thickness of the coating became 27 μm. Thereafter, a heat treatment was performed at 450° C. in a nitrogen gas or in the air so as to remove the binder. Then, another heat treatment was performed at 890° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 3 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

When the thickness of the nickel plating was 0.01 μm, the same results were obtained.

Furthermore, when the conductive powder contained up to 60 wt % of a nickel powder with an average particle diameter of 0.7 μm or less, the produced electrode for a PTC thermistor had a strong bond to the conductive polymer.

Furthermore, when a powder containing column-shaped particles or rectangular solid-shaped particles was used as the conductive powder, particularly preferable results were obtained. More specifically, when a powder with elliptical particles having a flatness ratio of 2 or more or a powder with acicular particles having an acicular ratio of 1.3 or more was used, a PTC thermistor having a small change ratio in resistance was obtained. Especially when a conductive powder whose particles were linked one after another was used, a PTC thermistor having a very small change ratio in resistance was obtained. This is believed to be because when these conductive powders are used, a large number of voids are formed in the sintered layer, so that the adhesion to the conductive polymer improves.

Example 11

In this Example, 120 g of vehicle A and 100 g of a conductive powder (a mixture of 80 g of a copper powder with an average particle diameter of 3 μm and 20 g of a nickel powder with an average particle diameter of 1 μm or less) were kneaded sufficiently to prepare a paste. A copper foil 60 μm thick (base layer) was coated with this paste by the doctor blade method so that the thickness of the coating became 20 μm. Thereafter, a heat treatment was performed at 450° C. in a nitrogen gas or in the air so as to remove the binder. Then, another heat treatment was performed at 900° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 2 μm. When a nickel foil 100 μm thick or a nickel sheet 1 mm thick was used as the base layer, the center line average roughness Ra was the same as above.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 12

In this Example, 120 g of vehicle A and 100 g of a conductive powder (a mixture of 80 g of a copper powder with an average particle diameter of 3 μm and 20 g of a nickel powder with an average particle diameter of 2 μm) were kneaded sufficiently to prepare a paste. A copper foil 60 μm thick (base layer) was coated with this paste by the doctor blade method so that the thickness of the coating became 27 μm. Thereafter, a heat treatment was performed at 450° C. in a nitrogen gas or in the air so as to remove the binder. Then, another heat treatment was performed at 900° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 3.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

When a titanium powder, a chromium powder, a cobalt powder, a silver powder, a gold powder, a brass powder, a bronze powder, a nickel silver powder, a palladium powder, a zinc powder, a tin powder, or a metal powder plated with nickel phosphorus or nickel boron were used, instead of the copper powder and the nickel powder, the same results as above were obtained.

Example 13

In this Example, 5 g of rosin and 100 g of α terpineol as a solvent were mixed to give a vehicle. Then, 105 g of this vehicle and 100 g of a conductive powder (a mixture of 90 g of a copper powder with an average particle diameter of 3 μm and 10 g of a tin powder with an average particle diameter of 1 μm or less) were kneaded sufficiently to prepare a paste. A copper foil 60 μm thick (base layer) was coated with this paste by the doctor blade method so that the thickness of the coating became 27 μm. Thereafter, a heat treatment was performed at 400° C. in a nitrogen gas so as to remove the binder. Then, another heat treatment was performed at 700° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 3.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

When the conductive powder contained the tin powder in an amount of 30 wt % or less (the copper powder in an amount of 70 wt % or more), good results were obtained.

Furthermore, when gold, palladium, silver, zinc, tin, iron, copper, nickel, cobalt, chromium, platinum, titanium, nickel silver, brass, bronze, powder, or a metal foil plated with nickel phosphorus or nickel boron were used as the base layer, the same results as above were obtained. Furthermore, when the base layer and the conductive powder were plated with the same material, the period of time for the heat treatments was shortened.

Example 14

In this Example, 100 g of vehicle A and 100 g of a nickel powder (conductive powder) with an average particle diameter of 3 μm were kneaded sufficiently to prepare a paste. A base layer (copper foil 60 μm thick) plated with palladium 2 μm thick was coated with this paste by the doctor blade method so that the thickness of the coating became 27 μm. Thereafter, a heat treatment was performed at 450° C. in a nitrogen gas or in the air so as to remove the binder. Then, another heat treatment was performed at 950° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 4.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 15

In this Example, 100 g of vehicle A and 100 g of a nickel powder (conductive powder) with an average particle diameter of 3 μm were kneaded sufficiently to prepare a paste. A base layer (copper foil 60 μm thick) plated with indium 1 μm thick was coated with this paste by the doctor blade method so that the thickness of the coating became 27 μm. Thereafter, a heat treatment was performed at 450° C. in a nitrogen gas or in the air so as to remove the binder. Then, another heat treatment was performed at 850° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 4 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 16

In this Example, 100 g of vehicle A and 100 g of a nickel powder (conductive powder) with an average particle diameter of 3 μm were kneaded sufficiently to prepare a paste. A base layer (copper foil 60 μm thick) plated with tin 1 μm thick was coated with this paste by the doctor blade method so that the thickness of the coating became 27 μm. Thereafter, a heat treatment was performed at 450° C. in a nitrogen gas or in the air so as to remove the binder. Then, another heat treatment was performed at 850° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 3.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 17

In this Example, 100 g of vehicle A and 100 g of a nickel powder (conductive powder) with an average particle diameter of 3 μm were kneaded sufficiently to prepare a paste. A base layer (copper foil 60 μm thick) plated with zinc 1 μm thick was coated with this paste by the doctor blade method so that the thickness of the coating became 90 μm. Thereafter, a heat treatment was performed at 450° C. in a nitrogen gas or in the air so as to remove the binder. Then, another heat treatment was performed at 870° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 4.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 18

In this Example, 100 g of vehicle A and 100 g of a nickel powder (conductive powder) with an average particle diameter of 3 μm were kneaded sufficiently to prepare a paste. A base layer (copper foil 60 μm thick) plated with nickel 1 μm thick was coated with this paste by the doctor blade method so that the thickness of the coating became 27 μm. Thereafter, a heat treatment was performed at 450° C. in a nitrogen gas or in the air so as to remove the binder. Then, another heat treatment was performed at 900° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 3 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 19

In this Example, 100 g of vehicle A and 100 g of a nickel powder (conductive powder) with an average particle diameter of 3 μm were kneaded sufficiently to prepare a paste. A base layer (copper foil 60 μm thick) plated with gold 1 μm thick was coated with this paste by the doctor blade method so that the thickness of the coating became 27 μm. Thereafter, a heat treatment was performed at 450° C. in a nitrogen gas or in the air so as to remove the binder. Then, another heat treatment was performed at 950° C. in a mixed gas (5% of hydrogen and 95% of nitrogen) for 5 minutes to form a sintered layer. Thus, an electrode for a PTC thermistor was obtained. The center line average roughness Ra of a surface of the thus formed sintered layer was 3.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

When the base layer was plated with platinum instead of gold, the same results as above were obtained.

Example 20

In this Example, 100 g of vehicle A and 100 g of a zinc powder (conductive powder) with an average particle diameter of 3 μm were kneaded sufficiently to prepare a paste. A copper foil 60 μm thick (base layer) was coated with this paste by the doctor blade method so that the thickness of the coating became 27 μm. Thereafter, a heat treatment was performed at 390° C. in a nitrogen gas or in the air so as to remove the binder. Then, another heat treatment was performed at 418° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 4.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 21

In this Example, 100 g of vehicle A and 100 g of a platinum powder (conductive powder) with an average particle diameter of 3 μm were kneaded sufficiently to prepare a paste. A copper foil 60 μm thick (base layer) was coated with this paste by the doctor blade method so that the thickness of the coating became 27 μm. Thereafter, a heat treatment was performed at 450° C. in a nitrogen gas or in the air so as to remove the binder. Then, another heat treatment was performed at 1000° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 2.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 22

In this Example, 100 g of vehicle A and 100 g of a palladium powder (conductive powder) with an average particle diameter of 3 μm were kneaded sufficiently to prepare a paste. A base layer (iron foil 60 μm thick) plated with Co 0.1 μm thick was coated with this paste by the doctor blade method so that the thickness of the coating became 27 μm. Thereafter, a heat treatment was performed at 450° C. in a nitrogen gas or in the air so as to remove the binder. Then, another heat treatment was performed at 950° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 3 μm. When a copper foil or a nickel foil was used as the base layer, the center line average roughness Ra was the same as above.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 23

In this Example, 100 g of vehicle A and 100 g of a titanium powder (conductive powder) with an average particle diameter of 3 μm were kneaded sufficiently to prepare a paste. A nickel foil 60 μm thick was coated with this paste by the doctor blade method so that the thickness of the coating became 27 μm. Thereafter, a heat treatment was performed at 450° C. in a nitrogen gas so as to remove the binder. Then, another heat treatment was performed at 1050° C. in a mixed gas (50% of hydrogen and 50% of carbon dioxide) for 5 minutes to form a sintered layer. Thus, an electrode for a PTC thermistor was obtained. The center line average roughness Ra of a surface of the thus formed sintered layer was 3 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 24

In this Example, 100 g of vehicle A and 100 g of a conductive powder (copper powder with an average particle diameter of 2 μm plated with nickel 0.5 μm thick) were kneaded sufficiently to prepare a paste. A base layer (iron foil 60 μm thick) plated with nickel 1 μm thick was coated with this paste by the doctor blade method so that the thickness of the coating became 27 μm. Thereafter, a heat treatment was performed at 450° C. in a nitrogen gas so as to remove the binder. Then, another heat treatment was performed at 900° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 3.5 μm. When a copper foil was used as the base layer, the center line average roughness Ra was the same as above.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 25

In this Example, 100 g of vehicle A and 100 g of a conductive powder (copper powder with an average particle diameter of 2 μm plated with tin 0.5 μm thick) were kneaded sufficiently to prepare a paste. A base layer (copper foil 60 μm thick) plated with nickel 1 μm thick was coated with this paste by the doctor blade method so that the thickness of the coating became 27 μm. Thereafter, a heat treatment was performed at 450° C. in a nitrogen gas so as to remove the binder. Then, another heat treatment was performed at 850° C. in a mixed gas (10% of hydrogen and 90% of nitrogen) for 5 minutes to form a sintered layer. Thus, an electrode for a PTC thermistor was obtained. The center line average roughness Ra of a surface of the thus formed sintered layer was 3 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 26

In this Example, 100 g of vehicle A and 100 g of a conductive powder (nickel powder with an average particle diameter of 2 μm plated with tin 0.5 μm thick) were kneaded sufficiently to prepare a paste. A base layer (copper foil 60 μm thick) plated with nickel 1 μm thick was coated with this paste by the doctor blade method so that the thickness of the coating became 27 μm. Thereafter, a heat treatment was performed at 450° C. in a nitrogen gas so as to remove the binder. Then, another heat treatment was performed at 830° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 3.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 27

In this Example, 100 g of vehicle A and 100 g of a conductive powder (iron powder with an average particle diameter of 2 μm plated with platinum 0.5 μm thick) were kneaded sufficiently to prepare a paste. A base layer (copper foil 60 μm thick) plated with nickel 1 μm thick was coated with this paste by the doctor blade method so that the thickness of the coating became 27 μm. Thereafter, a heat treatment was performed at 450° C. in a nitrogen gas so as to remove the binder. Then, another heat treatment was performed at 950° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 3.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

When a copper powder plated with zinc, gold, platinum, silver, chromium, cobalt, indium or palladium was used as the conductive powder, the same results as above were obtained. Also when a copper powder plated with nickel phosphorus or nickel boron was used as the conductive powder, the same results as above were obtained. Also a when nickel powder plated with zinc, gold, platinum, chromium, cobalt, indium, copper, palladium, nickel phosphorus or nickel boron was used as the conductive powder, the same results as above were obtained. Also when an iron powder plated with tin, zinc, platinum, nickel, copper, silver, chromium, cobalt, indium, palladium, nickel phosphorus or nickel boron was used as the conductive powder, the same results as above were obtained. Also when a chromium powder plated with tin, zinc, platinum, nickel, copper, silver, cobalt, indium, gold, palladium, nickel phosphorus or nickel boron was used as the conductive powder, the same results as above were obtained. Also when a silver powder plated with tin, zinc, nickel, platinum, gold, copper, chromium, cobalt, indium, palladium, nickel phosphorus or nickel boron was used as the conductive powder, the same results as above were obtained. Also when a cobalt powder plated with tin, zinc, platinum, nickel, copper silver, chromium, indium, gold, palladium, nickel phosphorus or nickel boron was used as the conductive powder, the same results as above were obtained. Also when a zinc powder, a platinum powder, a gold powder, or a tin powder plated with the above-mentioned metals or alloys thereof was used as the conductive powder, the same results as above were obtained. When the thickness of the plating was 0.1 μm to 2 μm, good results were obtained.

Example 28

In this Example, 100 g of vehicle A and 100 g of a conductive powder (a mixture of 95 g of a silver powder with an average particle diameter of 3 μm and 5 g of a tin powder with an average particle diameter of 3 μm) were kneaded sufficiently to prepare a paste. A copper foil 60 μm thick (base layer) was coated with this paste by the doctor blade method so that the thickness of the coating became 27 μm. Thereafter, a heat treatment was performed at 450° C. in a nitrogen gas so as to remove the binder. Then, another heat treatment was performed at 800° C. in a mixed gas (15% of hydrogen and 85% of nitrogen) for 5 minutes to form a sintered layer. Thus, an electrode for a PTC thermistor was obtained. The center line average roughness Ra of a surface of the thus formed sintered layer was 3.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

In this example, when the conductive powder contained the silver powder in an amount of 40 wt % or more (the content of the tin powder was 60 wt % or less), good results were obtained.

Example 29

In this Example, 100 g of vehicle A and 100 g of a conductive powder (a mixture of 95 g of a copper powder with an average particle diameter of 3 μm and 5 g of a zinc powder with an average particle diameter of 3 μm) were kneaded sufficiently to prepare a paste. A copper foil 60 μm thick (base layer) was coated with this paste by the doctor blade method so that the thickness of the coating became 27 μm. Thereafter, a heat treatment was performed at 400° C. in a nitrogen gas so as to remove the binder. Then, another heat treatment was performed at 825° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 3.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

In this example, also when the contents of the copper powder and the zinc powder in the conductive powder were changed, good results were obtained.

Example 30

In this Example, 100 g of vehicle A and 100 g of a conductive powder (a mixture of 95 g of a silver powder with an average particle diameter of 3 μm and 5 g of a zinc powder with an average particle diameter of 2 μm) were kneaded sufficiently to prepare a paste. A copper foil 60 μm thick (base layer) was coated with this paste by the doctor blade method so that the thickness of the coating became 27 μm. Thereafter, a heat treatment was performed at 400° C. in a nitrogen gas so as to remove the binder. Then, another heat treatment was performed at 825° C. in a mixed gas (8% of hydrogen and 92% of nitrogen) for 5 minutes to form a sintered layer. Thus, an electrode for a PTC thermistor was obtained. The center line average roughness Ra of a surface of the thus formed sintered layer was 2.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

In this example, also when the contents of the silver powder and the zinc powder in the conductive powder were changed, good results were obtained.

Example 31

In this Example, 100 g of vehicle A and 100 g of a conductive powder (a mixture of 95 g of a nickel powder with an average particle diameter of 3 μm and 5 g of a zinc powder with an average particle diameter of 3 μm) were kneaded sufficiently to prepare a paste. A copper foil 60 μm thick (base layer) was coated with this paste by the doctor blade method so that the thickness of the coating became 27 μm. Thereafter, a heat treatment was performed at 400° C. in a nitrogen gas so as to remove the binder. Then, another heat treatment was performed at 825° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 2.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

In this example, also when the contents of the nickel powder and the zinc powder in the conductive powder were changed, good results were obtained.

Example 32

In this Example, 100 g of vehicle A and 100 g of a conductive powder (a mixture of 95 g of a nickel powder with an average particle diameter of 3 μm and 5 g of a tin powder with an average particle diameter of 3 μm) were kneaded sufficiently to prepare a paste. A copper foil 60 μm thick (base layer) was coated with this paste by the doctor blade method so that the thickness of the coating became 27 μm. Thereafter, a heat treatment was performed at 450° C. in a nitrogen gas so as to remove the binder. Then, another heat treatment was performed at 825° C. in a mixed gas (20% of hydrogen and 80% of nitrogen) for 5 minutes to form a sintered layer. Thus, an electrode for a PTC thermistor was obtained. The center line average roughness Ra of a surface of the thus formed sintered layer was 3.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

In this example, when the conductive powder contained the nickel powder in an amount of 40 wt % or more (the content of the tin powder was 60 wt % or less), good results were obtained.

Example 33

In this Example, 100 g of vehicle A and 100 g of a conductive powder (a mixture of 95 g of a cobalt powder with an average particle diameter of 3 μm and 5 g of a zinc powder with an average particle diameter of 3 μm) were kneaded sufficiently to prepare a paste. A copper foil 60 μm thick (base layer) was coated with this paste by the doctor blade method so that the thickness of the coating became 27 μm. Thereafter, a heat treatment was performed at 400° C. in a nitrogen gas containing 50 mmHg water vapor so as to remove the binder. Then, another heat treatment was performed at 845° C. in a mixed gas (1% of hydrogen and 99% of nitrogen) for 5 minutes to form a sintered layer. Thus, an electrode for a PTC thermistor was obtained. The center line average roughness Ra of a surface of the thus formed sintered layer was 3 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

In this example, also when the contents of the nickel powder and the zinc powder were changed, good results were obtained.

Example 34

In this Example, 100 g of vehicle A and 100 g of a conductive powder (a mixture of 50 g of a nickel powder with an average particle diameter of 3 μm and 50 g of a copper powder with an average particle diameter of 3 μm) were kneaded sufficiently to prepare a paste. A base layer (a copper foil 60 μm thick) plated with nickel 0.5 μm thick was coated with this paste by the doctor blade method so that the thickness of the coating became 100 μm. Thereafter, a heat treatment was performed at 450° C. in a nitrogen gas or in the air so as to remove the binder. Then, another heat treatment was performed at 950° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 6 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 35

In this Example, 100 g of vehicle A and 100 g of a conductive powder (a mixture of 5 g of an indium powder with an average particle diameter of 3 μm and 95 g of a copper powder with an average particle diameter of 3 μm) were kneaded sufficiently to prepare a paste. A copper foil 60 μm thick (base layer) was coated with this paste by the doctor blade method so that the thickness of the coating became 27 μm. Thereafter, a heat treatment was performed at 400° C. in a nitrogen gas so as to remove the binder. Then, another heat treatment was performed at 700° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 3.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

When the conductive powder contained the copper powder in an amount of 40 wt % or more (the content of the indium powder was 60 wt % or less), good results were obtained.

Example 36

In this Example, 100 g of vehicle A and 100 g of a conductive powder (a mixture of 5 g of a tin powder with an average particle diameter of 3 μm, 5 g of a copper powder with an average particle diameter of 2 μm and 90 g of a nickel powder with an average particle diameter of 3 μm) were kneaded sufficiently to prepare a paste. A copper foil 60 μm thick (base layer) was coated with this paste by the doctor blade method so that the thickness of the coating became 27 μm. Thereafter, a heat treatment was performed at 400° C. in a nitrogen gas so as to remove the binder. Then, another heat treatment was performed at 700° C. in a mixed gas (10% of hydrogen and 90% of nitrogen) for 5 minutes to form a sintered layer. Thus, an electrode for a PTC thermistor was obtained. The center line average roughness Ra of a surface of the thus formed sintered layer was 3 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

When the conductive powder contained the tin powder in an amount of 60 wt % or less, good results were obtained.

Example 37

In this Example, 100 g of vehicle A and 92 g of a conductive powder (a mixture of 1 g of a tin powder with an average particle diameter of 2 μm, 1 g of a zinc powder with an average particle diameter of 2 μm and 90 g of a nickel powder with an average particle diameter of 2 μm) were kneaded sufficiently to prepare a paste. A copper foil 60 μm thick (base layer) was coated with this paste by the doctor blade method so that the thickness of the coating became 27 μm. Thereafter, a heat treatment was performed at 400° C. in a nitrogen gas so as to remove the binder. Then, another heat treatment was performed at 750° C. in a mixed gas (10% of hydrogen and 90% of nitrogen) for 5 minutes to form a sintered layer. Thus, an electrode for a PTC thermistor was obtained. The center line average roughness Ra of a surface of the thus formed sintered layer was 2 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 38

In this Example, 100 g of vehicle A and 100 g of a nickel powder (conductive powder) with an average particle diameter of 6 μm were kneaded sufficiently to prepare a paste. A base layer (a copper foil 60 μm thick) plated with nickel 1 μm thick was coated with this paste by the doctor blade method so that the thickness of the coating became 60 μm. Thereafter, a heat treatment was performed at 400° C. in a nitrogen gas so as to remove the binder. Then, another heat treatment was performed at 900° C. in a mixed gas (20% of hydrogen and 80% of nitrogen) for 10 minutes to form a sintered layer. Thus, an electrode for a PTC thermistor was obtained. The center line average roughness Ra of a surface of the thus formed sintered layer was 7 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 39

In this Example, 130 g of vehicle A and 100 g of a conductive powder (a mixture of 5 g of a tin powder with an average particle diameter of 0.2 μm, 5 g of a zinc powder with an average particle diameter of 0.2 μm and 90 g of a nickel powder with an average particle diameter of 0.2 μm) were kneaded sufficiently to prepare a paste. A base layer (a copper foil 60 μm thick) was coated with this paste by die coating (at a coating rate of 10 mm/sec) so that the thickness of the coating became 5 μm. Thereafter, a heat treatment was performed at 400° C. in a nitrogen gas so as to remove the binder. Then, another heat treatment was performed at 700° C. in a mixed gas (50% of hydrogen and 50% of nitrogen) for 5 minutes to form a dense sintered layer.

Next, a vehicle was prepared by mixing 5 wt % of a butyral resin, and 25 wt % of butyl acetate and 70 wt % of butyl cellosolve as solvents. Then, 100 g of this vehicle and 100 g of a conductive powder (a mixture of 5 g of a tin powder with an average particle diameter of 2 μm, 5 g of a zinc powder with an average particle diameter of 2 μm and 90 g of a nickel powder with an average particle diameter of 2 μm) were kneaded sufficiently to prepare a paste. The aforementioned dense sintered layer was coated with this paste by the doctor blade method so that the thickness of the coating became 27 μm. Thereafter, a heat treatment was performed at 400° C. in a nitrogen gas so as to remove the binder. Then, another heat treatment was performed at 700° C. in a mixed gas (50% of hydrogen and 50% of nitrogen) for 5 minutes to form a sintered layer. Thus, an electrode for a PTC thermistor including a sintered layer consisting of the two sintered layers, namely, the dense sintered layer and the rough sintered layer, was obtained. The center line average roughness Ra of a surface of the sintered layer was 1.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

When the conductive powder contained four or more metal powders by adding a copper powder or the like, the same results as those shown in Tables 1 and 2 were obtained.

In the formation of the dense sintered layer, in the case where metal powders with an average diameter of 0.7 μm were used instead of the metal powders with an average diameter of 0.2 μm, it is necessary to raise the firing temperature by 30° C. In this case, although the center line average roughness Ra became large, the same results as those shown in Tables 1 and 2 were obtained.

An electrode for a PTC thermistor having two sintered layers also can be produced in the following method. First, 130 g of vehicle A and 100 g of a conductive powder (a mixture of 5 g of a tin powder with an average particle diameter of 0.2 μm, 5 g of a zinc powder with an average particle diameter of 0.2 μm and 90 g of a nickel powder with an average particle diameter of 0.2 μm) were kneaded sufficiently to prepare a first paste. A base layer (a copper foil 60 μm thick) was coated with the first paste by a die coating method (at a coating rate of 10 mm/sec) so that the thickness of the coating became 5 μm. The coated first paste was dried. Next, a vehicle was prepared by mixing 5 wt % of a butyral resin, and 25 wt % of butyl acetate and 70 wt % of butyl cellosolve as solvents. Then, 100 g of this vehicle and 100 g of conductive powder (a mixture comprising 5 g of a tin powder with an average particle diameter of 2 μm, 5 g of a zinc powder with an average particle diameter of 2 μm and 90 g of a nickel powder with an average particle diameter of 2 μm) were kneaded sufficiently to prepare a second paste. The copper foil coated with the first paste was coated with the second paste by the doctor blade method at an coating rate of 10 mm/sec so that the thickness of the coating became 27 μm. Thereafter, a heat treatment was performed at 400° C. in a nitrogen gas so as to remove the binder. Then, another heat treatment was performed at 700° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 1.7 μm. Then, a PTC thermistor was produced with the thus produced electrodes. The resulting PTC thermistor had a resistance value of 46 mΩ before the test, a resistance value of 68 mΩ after the test, a change ratio in resistance of 48%, a peel strength of 2.2 kgf/cm$^2$.

Example 40

In this Example, 100 g of vehicle A and 100 g of a nickel powder (conductive powder) with an average particle diameter of 3 μm were kneaded sufficiently to prepare a paste. A base layer (a copper foil 60 μm thick) plated with nickel 1 μm thick was coated with this paste by the doctor blade method so that the thickness of the coating became 27 μm. The copper foil as the base layer had been subjected to a sandblast treatment using alumina powder (that has passed through a 220-mesh) before the plating, so that the surface thereof was rough. Thereafter, a heat treatment was performed at 390° C. in a nitrogen gas so as to remove the binder. Then, another heat treatment was performed at 890° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 3.5 μm.

In this example, good results were obtained regardless of the type of the metal foil as the base layer, whether or not the metal foil was plated, or whether or not the metal foil was plated.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 41

In this Example, 100 g of vehicle A and 100 g of a nickel powder (conductive powder) with an average particle diameter of 3 μm were kneaded sufficiently to prepare a paste. A base layer (a copper foil 60 μm thick that had been subjected to chemical etching with 3 normal nitric acid so as to have roughness on the surface) was coated with this paste by the doctor blade method so that the thickness of the coating became 27 μm. Thereafter, a heat treatment was performed at 500° C. in a nitrogen gas so as to remove the binder. Then, another heat treatment was performed at 1000° C., in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 3 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

As the etching solution used for the etching of the base layer to form roughness on the surface, various solutions can be used. However, a particularly large roughness was formed when a nitric acid-hydrogen peroxide based etching solution was used. The selection of the etching solution provided good results regardless of the type of the metal foil as the base layer, whether or not the metal foil was plated, or whether or not the conductive powder was plated.

Example 42

In this Example, 100 g of vehicle A and 100 g of a nickel powder (conductive powder) with an average particle diameter of 2 μm were kneaded sufficiently to prepare a paste. A base layer (a copper foil 60 μm thick that had been subjected to electrolytic etching in an aqueous solution of 3 normal sodium chloride before plating so as to have roughness on the surface) plated with nickel 0.1 μm thick was coated with this paste by the doctor blade method so that the thickness of the coating became 27 μm. Thereafter, a heat treatment was performed at 390° C. in a nitrogen gas so as to remove the binder. Then, another heat treatment was performed at 890° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 3.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Also when a copper foil that had been subjected to metallicon (sprayed metal coating) so as to have roughness on the surface thereof was used, the same results as above were obtained.

Example 43

A vehicle was prepared by mixing 4 wt % of ethyl cellulose, and 48 wt % of ethanol and 48 wt % of toluene as solvents. Then, 100 g of this vehicle and 100 g of a nickel powder (conductive powder) with an average particle diameter of 2 μm were kneaded sufficiently to prepare a paste. A base layer (a copper foil 60 μm thick) plated with nickel 1 μm thick was coated with this paste by the doctor blade method so that the thickness of the coating became 27 μm. Thereafter, a heat treatment was performed at 390° C. in a nitrogen gas so as to remove the binder. Then, another heat treatment was performed at 900° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 2.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 44

In this Example, 100 g of vehicle A and 100 g of a conductive powder (a mixture of 5 g of an iron powder with an average particle diameter of 2 μm plated with nickel 0.5 μm thick, 5 g of a copper powder with an average particle diameter of 2 μm plated with nickel 0.5 μm thick and 90 g of a nickel powder with an average particle diameter of 2 μm) were kneaded sufficiently to prepare a paste. A base layer (a copper foil 60 μm thick) plated with nickel 1 μm thick was coated with this paste by the doctor blade method so that the thickness of the coating became 27 μm. Thereafter, a heat treatment was performed at 450° C. in a nitrogen gas so as to remove the binder. Then, another heat treatment was performed at 900° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 2 μm Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 45

In this Example, 80 g of vehicle A and 100 g of a conductive powder (a mixture of 5 g of a tin powder with an average particle diameter of 2 μm, 5 g of a zinc powder with an average particle diameter of 2 μm and 90 g of a nickel powder with an average particle diameter of 50 μm) were kneaded sufficiently to prepare a paste. A base layer (a copper foil 60 μm thick) plated with nickel 1 μm thick was coated with this paste by the doctor blade method so that the thickness of the coating became 150 μm. Thereafter, a heat treatment was performed at 390° C. in a nitrogen gas so as to remove the binder. Then, another heat treatment was performed at 700° C. in a mixed gas (50% of hydrogen and 50% of nitrogen) for 15 minutes to form a sintered layer. Thus, an electrode for a PTC thermistor was obtained. The center line average roughness Ra of a surface of the thus formed sintered layer was 20 μm.

When a conductive powder with an average particle diameter of 50 μm was used as the conductive powder, the conductive powder was prevented from precipitating in the paste, so that the paste was applied to the base layer particularly easily.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

When the conductive powder contained the nickel powder in an amount of 40 wt % or more, the adhesion to the copper foil was particularly large.

Example 46

In this Example, 110 g of vehicle A and 100 g of a conductive powder (a mixture of 5 g of a tin powder with an average particle diameter of 0.7 μm, 5 g of a zinc powder with an average particle diameter of 0.7 μm and 90 g of a nickel powder with an average particle diameter of 0.7 μm) were kneaded sufficiently to prepare a paste. A base layer (a copper foil 60 μm thick) plated with nickel 1 μm thick was coated with this paste by the doctor blade method so that the thickness of the coating became 27 μm. Thereafter, a heat treatment was performed at 390° C. in a nitrogen gas so as to remove the binder. Then, another heat treatment was performed at 700° C. in a hydrogen gas for 15 minutes to form a sintered layer. Thus, an electrode for a PTC thermistor was obtained. The center line average roughness Ra of a surface of the thus formed sintered layer was 0.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

When the conductive powder contained the nickel powder in an amount of 70 wt % or more, the adhesion to the copper foil was particularly large.

In this example, a cellulose resin such as methyl cellulose, ethyl cellulose and cellulose nitrate, an acrylic resin, a polyacetal resin, a polyvinyl alcohol resin, or rosin may be used instead of the butyral resin.

Example 47

In this Example, 100 g of an aqueous solution containing 3.5 wt % of methyl cellulose and 90 g of a nickel powder (conductive powder) with an average particle diameter of 2 μm were kneaded sufficiently to prepare a paste. A copper foil 60 μm thick (base layer) was coated with this paste by the doctor blade method, a reversible rolling method or a screen printing method (at a coating rate of 10 mm/sec) so that the thickness of the coating became 27 μm.

Thereafter, a roll treatment or a heat pressing treatment was performed at 350° C. in a nitrogen gas, preferably including up to 5% of hydrogen gas.

Thereafter, a heat treatment was performed at 450° C. so as to remove the binder. Then, another heat treatment was performed at 950° C. in a mixed gas (35% of hydrogen and 65% of nitrogen) for 5 minutes to form a sintered layer. Thus, an electrode for a PTC thermistor was obtained. The center line average roughness Ra of a surface of the thus formed sintered layer was 2 μm. The adhesion between the base layer and the nickel powder became larger when the roll treatment or the heat pressing treatment was performed at high temperatures (e.g., 350° C. or more) rather than low temperatures such as room temperature.

Also when a nickel foil, an iron foil plated with nickel, a copper foil plated with nickel, or a metal foil plated with nickel, copper, silver, gold, palladium, zinc, chromium, platinum, tin, cobalt, indium, phosphor bronze, brass, nickel silver, nickel phosphorus, nickel boron, alloys or compounds of these metals were used as the base layer, the same results as above were obtained.

Also when a conductive powder containing copper, silver, zinc, palladium, gold, platinum, cobalt, iron, titanium, nickel phosphorus, nickel boron, molybdenum, tungsten, manganese, lead, or alloys of these metals, or a conductive powder containing these metals plated was used as the conductive powder, good results were obtained.

In particular, when the base layer and the conductive powder were plated with nickel phosphorous or nickel boron, good results were obtained.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

Example 48

In this Example, 100 g of vehicle A and 100 g of a nickel powder (conductive powder) with an average particle diameter of 3 μm were kneaded sufficiently to prepare a paste. A base layer (a copper foil 60 μm thick) plated with nickel phosphorus 1 μm thick by electroless plating was coated with this paste by the doctor blade method so that the thickness of the coating became 27 μm. Thereafter, a heat treatment was performed at 450° C. in a nitrogen gas or in the air so as to remove the binder. Then, another heat treatment was performed at 800° C. in a mixed gas (50% of hydrogen and 50% of nitrogen) for 5 minutes to form a sintered layer. Thus, an electrode for a PTC thermistor was obtained. The center line average roughness Ra of a surface of the thus formed sintered layer was 3.5 μm.

When the base layer was plated with nickel boron instead of the nickel phosphorus, the same results as above were obtained.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

When a nickel foil, an iron foil plated with nickel, a copper foil plated with nickel, or a metal foil plated with nickel, copper, silver, gold, palladium, zinc, chromium, platinum, tin, cobalt, indium, phosphor bronze, nickel silver, nickel phosphorus, nickel boron, alloys or compounds of these metals were used as the base layer, the same results as above were obtained When a conductive powder containing copper, silver, zinc, palladium, gold, platinum, cobalt, iron, titanium, nickel phosphorus or nickel boron, or a conductive powder containing these metals plated was used as the conductive powder, good results were obtained.

COMPARATIVE EXAMPLE

A copper foil formed by plating (electrolytic copper foil) was plated with nickel 1 μm thick, and further nickel was precipitated on the nickel plating by electrodeposition in an increased current density so that the surface thereof became rough. The center line average roughness Ra of a surface of the thus formed nickel plating layer was 1.5 μm.

Thereafter, a PTC thermistor was produced with two electrodes produced as above, in the same manner as in Example 1. Then, the overcurrent application cycle test and the peeling test were conducted under the same conditions as in Example 1 (see Tables 1 and 2).

As shown in Table 1, the change ratio in resistance of the PTC thermistor of the comparative example was more than 50%. Moreover, after the overcurrent application cycle test, it was impossible to pass a current of 1A (a current that is ensured to flow) through the PTC thermistor of the comparative example. On the other hand, the change ratios in resistance of the PTC thermistors of Examples 1 to 48 were less than 50%. Moreover, even after the overcurrent application cycle test, it was possible to pass a current of 1A through the PTC thermistors of Examples 1 to 48.

Furthermore, as shown in Table 2, the peel strength between the electrode for a PTC thermistor and the conductive polymer in the PTC thermistor of the comparative example was small, whereas the peel strengths of the PTC thermistors of Examples 1 to 48 were 1 kgf/cm$^2$ or more, which causes no problem for practical use.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A method for producing a PTC thermistor comprising: coating a surface of a base layer having electrical conductivity with a paste containing a polymer compound and a conductive powder with an average particle diameter of 0.1 μm to 50 μm;

heating the paste to remove the polymer compound and to sinter the conductive powder, thereby forming a sintered layer on the base layer, wherein voids are formed in the sintered layer; and arranging the base layer so that the sintered layer is in contact with at least one surface of a crystalline polymer containing conductive particles.

2. The method for producing a PTC thermistor according to claim 1, further comprising a step of forming a metal film on a surface of the base layer before the step of coating.

3. The method for producing a PTC thermistor according to claim 1, further comprising a step of forming roughness on a surface of the base layer before the step of coating.

4. The method for producing a PTC thermistor according to claim 1, wherein the average particle diameter of the conductive powder is from 0.1 μm to 1 μm, the method further comprising a step of coating the sintered layer with a paste containing a conductive powder with an average particle diameter of not less than 1 μm and performing a heat treatment so as to form another sintered layer laminated on the sintered layer before the step of arranging.

5. The method for producing a PTC thermistor according to claim 1, wherein the coating step further comprises a step of pressing the paste with which the base layer is coated into a sheet and drying the paste after coating the base layer with the paste.

6. The method for producing a PTC thermistor according to claim 1, wherein the heating is performed in a reducing atmosphere.

7. The method for producing a PTC thermistor according to claim 1, wherein the conductive powder is formed of a metallic material comprising at least one element selected from the group consisting of iron, nickel, copper, silver, gold, palladium, zinc, chromium, platinum, tin, cobalt, indium and titanium.

8. The method for producing a PTC thermistor according to claim 1, wherein the base layer is formed of a metallic material comprising at least one element selected from the group consisting of iron, copper and nickel.

* * * * *

UNITED STATES PATENT AND TRADEMARK OFFICE

CERTIFICATE OF CORRECTION

PATENT NO. : 6,558,616 B2
DATED : May 6, 2003
INVENTOR(S) : Ito et al.

It is certified that error appears in the above-identified patent and that said Letters Patent is hereby corrected as shown below:

Title page,
Item [62], Related U.S. Publication Data, "Oct. 29, 1999." should read
-- Nov. 2, 1999 --
Item [56], References Cited, U.S. PATENT DOCUMENTS, in Patent No. 5,955,936, "Shar, Jr. et al." should read -- Shaw, Jr. et al. --

Signed and Sealed this

Thirtieth Day of March, 2004

JON W. DUDAS
*Acting Director of the United States Patent and Trademark Office*